US010206437B2

(12) United States Patent
Behrend et al.

(10) Patent No.: US 10,206,437 B2
(45) Date of Patent: Feb. 19, 2019

(54) PROTECTIVE PAD USING A DAMPING COMPONENT

(71) Applicant: Nike, Inc., Beaverton, OR (US)

(72) Inventors: Carl Behrend, Portland, OR (US); Oliver McLachlan, Portland, OR (US); Catherine F. Morrison, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 630 days.

(21) Appl. No.: 13/832,730

(22) Filed: Mar. 15, 2013

(65) Prior Publication Data

US 2013/0232674 A1 Sep. 12, 2013

Related U.S. Application Data

(63) Continuation-in-part of application No. 13/415,442, filed on Mar. 8, 2012.

(51) Int. Cl.
*A41D 13/00* (2006.01)
*A41D 13/015* (2006.01)
(Continued)

(52) U.S. Cl.
CPC ..... *A41D 13/0002* (2013.01); *A41D 13/0156* (2013.01); *A41D 13/0543* (2013.01);
(Continued)

(58) Field of Classification Search
CPC ..... A41D 13/0005; A41D 13/0015; A41D 13/015; A41D 13/0156; A41D 13/0158;
(Continued)

(56) References Cited

U.S. PATENT DOCUMENTS 3,514,156 A * 5/1970 Fields ..... B62J 1/00 297/452.45
4,993,076 A * 2/1991 Dierickx ..... A41D 13/0158 2/2.5
(Continued)

FOREIGN PATENT DOCUMENTS

CN 2207091 Y 9/1995
DE 4128958 A1 3/1993
(Continued)

OTHER PUBLICATIONS

Notification of Transmittal of the International Search Report and the Written Opinion of the International Searching Authority, or the Declaration in PCT/US13/058772 dated Feb. 11, 2014, 43 pages.
(Continued)

*Primary Examiner* — Sally Haden
(74) *Attorney, Agent, or Firm* — Shook, Hardy & Bacon L.L.P.

(57) ABSTRACT

Embodiments of the present invention relate to a protective pad that is comprised of an impact shell and a damping component. The damping component may be formed by a plurality of connecting members that are separated from the impact shell by a plurality of extension members that extend between the damping lattice and the impact shell. The damping component may also be formed by a sheet-like form that is separated from the impact shell by a plurality of extension members that extend between the damping sheet and the impact shell. The damping component is formed from an elastomer that aids in absorbing a portion of an impact force that is distributed across the damping component by the impact shell. The dampening component may be affixed to the impact shell by way of a coupling frame that is incorporated into the impact shell.

6 Claims, 15 Drawing Sheets

(51) Int. Cl.

| | |
|---|---|
| ***A41D 13/05*** | (2006.01) |
| ***A63B 71/08*** | (2006.01) |
| *A63B 71/12* | (2006.01) |
| *A63B 71/00* | (2006.01) |

(52) U.S. Cl.
CPC ..... *A63B 71/08* (2013.01); *A63B 2071/0063* (2013.01); *A63B 2071/1258* (2013.01); *A63B 2209/02* (2013.01); *A63B 2209/023* (2013.01); *A63B 2209/10* (2013.01)

(58) Field of Classification Search
CPC .... A41D 13/05; A41D 13/0543; A41D 13/06; A63B 71/1225; A63B 71/1258
See application file for complete search history.

(56) References Cited

U.S. PATENT DOCUMENTS

| | | | | |
|---|---|---|---|---|
| 5,007,111 | A * | 4/1991 | Adams | A41B 11/02 2/22 |
| 5,524,641 | A | 6/1996 | Battaglia et al. | |
| 5,853,844 | A | 12/1998 | Wen | |
| 5,940,888 | A | 8/1999 | Sher | |
| 6,615,832 | B1 * | 9/2003 | Chen | A62B 18/08 128/205.25 |
| 6,654,960 | B2 * | 12/2003 | Cho | A63B 71/1225 2/22 |
| 8,166,573 | B1 * | 5/2012 | Chung | A42B 3/32 2/411 |
| 2002/0188997 | A1 * | 12/2002 | Lyden | A41D 13/0153 2/22 |
| 2004/0019950 | A1 | 2/2004 | Rast | |
| 2006/0179538 | A1 * | 8/2006 | Dodd | A41D 13/0153 2/22 |
| 2008/0290704 | A1 | 11/2008 | Chipkar | |
| 2009/0276933 | A1 | 11/2009 | Dodd | |
| 2010/0007115 | A1 * | 1/2010 | Wootton | A41D 13/0002 280/304.4 |
| 2010/0129573 | A1 * | 5/2010 | Kim | A41D 31/005 428/34.1 |
| 2010/0205722 | A1 * | 8/2010 | Kim | A41D 31/005 2/455 |
| 2010/0299812 | A1 * | 12/2010 | Maddux | A42B 3/124 2/414 |
| 2011/0131695 | A1 | 6/2011 | Maddux et al. | |
| 2012/0090068 | A1 * | 4/2012 | Glass | A41D 13/0543 2/22 |
| 2013/0232674 | A1 * | 9/2013 | Behrend | A41D 13/0002 2/455 |

FOREIGN PATENT DOCUMENTS

| | | | |
|---|---|---|---|
| DE | 29719930 | U1 | 3/1999 |
| DE | 10219521 | A1 | 11/2003 |
| EP | 1588636 | | 10/2005 |
| JP | 2002017938 | A | 1/2002 |
| JP | 2008111213 | | 5/2008 |
| JP | 2008214841 | A | 9/2008 |
| WO | 2009102268 | A1 | 8/2009 |

OTHER PUBLICATIONS

Notification of Transmittal of the International Search Report and the Written Opinion of the International Searching Authority, or the Declaration in PCT/US13/29813 dated May 16, 2013, 21 pages.
International Preliminary Report on Patentability dated Sep. 24, 2015 in Application No. PCTUS2013/058772, 8 pages.
"Elastomer" Wikipedia. Wikimedia Foundation, n.d. Web. Jun. 19, 2015.
"Foraminous." The Free Dictionary. Farlex, n.d. Web. Jun. 19, 2015.
Non-Final Office Action dated Jul. 1, 2015 in U.S. Appl. No. 13/415,442, 37 pages.
International Preliminary Report on Patentability dated Sep. 9, 2014 in Application No. PCTUS2013/029813, 7 pages.
European Search Report dated Nov. 17, 2015 in Application No. 13757868.8, 8 pages.
Final Office Action dated Jan. 22, 2016 in U.S. Appl. No. 13/415,442, 26 pages.
Chinese Office Action with Search Report dated Aug. 16, 2016 in Chinese Patent Application No. 2013800746148, 7 Pages.
European Search Report dated Oct. 18, 2016 in European Patent Application No. 13877524.2, 8 pages.
Office Action dated Jan. 31, 2017 in Japanese Patent Application No. 2016-500089, 4 pages.
Non-Final Office Action dated Jan. 10, 2017 in U.S. Appl. No. 13/415,442, 19 pages.
Final Office Action dated Aug. 23, 2017 in U.S. Appl. No. 13/415,442, 25 pages.

* cited by examiner

PROTECTIVE PAD USING A DAMPING COMPONENT

This application is a continuation in part of U.S. patent application Ser. No. 13/415,442, filed Mar. 8, 2012, entitled "Protective Pad Using a Damping Component,", which is incorporated herein by reference.

BACKGROUND

Protective pads are traditionally used to limit an impact force experienced by a person or an object. Some examples of protective padding rely on foam-like materials that are placed between a protected surface and a point of impact. Traditional foam may have limitations with respect to repeated cleaning, such as high-temperature washing, bulkiness, and manufacturing limitations.

SUMMARY

Embodiments of the present invention relate to a protective pad that is comprised of an impact shell and a damping component. The damping component may be formed by a plurality of connecting members that are separated from the impact shell by a plurality of extension members that extend between a damping lattice and the impact shell. The damping component may additionally or alternatively be formed by a sheet-like form that is separated from the impact shell by a plurality of extension members that extend between the solid sheet and the impact shell. The damping component absorbs a portion of an impact force that is distributed across the damping component by the impact shell. The geometry of the damping component may be configured to provide a desired level of impact attenuation at specific locations of the protective pad. The dampening component may be affixed with the impact shell by way of a coupling frame incorporated along a perimeter of the impact shell. The coupling frame may be overmolded into the impact shell along the perimeter of impact shell and plurality of perforations proximate the perimeter.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

BRIEF DESCRIPTION OF THE SEVERAL VIEWS OF THE DRAWINGS

Illustrative embodiments of the present invention are described in detail below with reference to the attached drawing figures, which are incorporated by reference herein and wherein.

DETAILED DESCRIPTION

Figure 1:
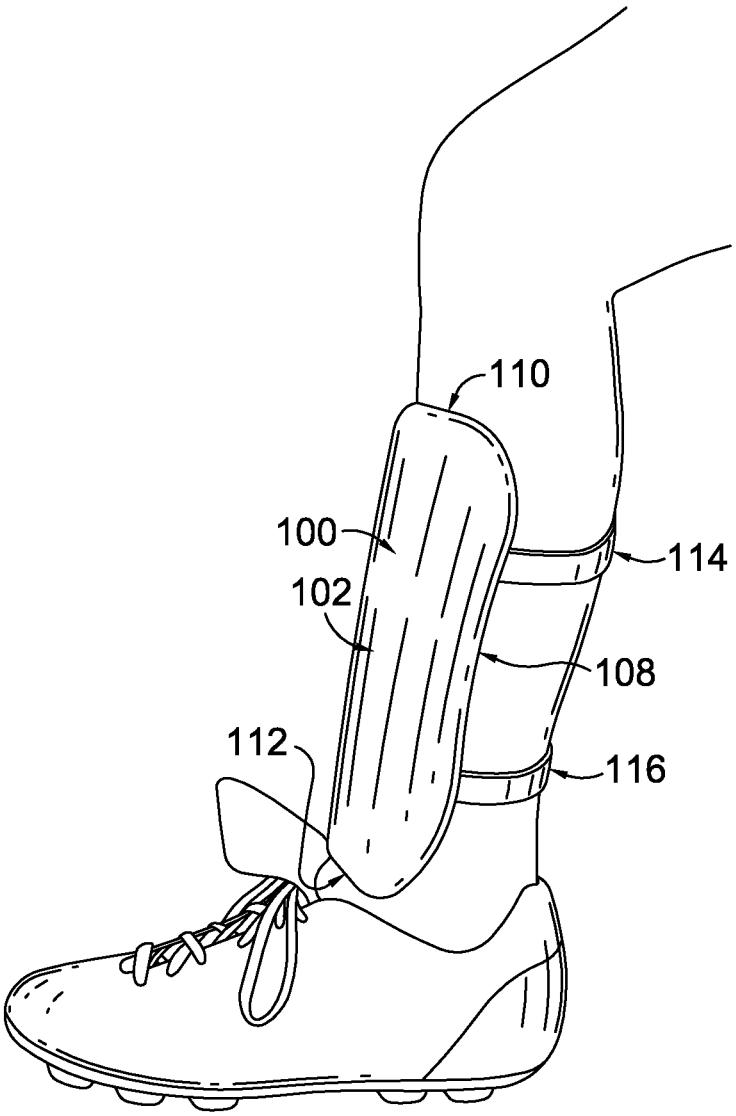
FIG. 1 illustrates an exemplary protective pad, in accordance with aspects of the present invention.

The subject matter of embodiments of the present invention is described with specificity herein to meet statutory requirements. However, the description itself is not intended to limit the scope of this patent. Rather, the inventors have contemplated that the claimed subject matter might also be embodied in other ways, to include different elements or combinations of elements similar to the ones described in this document, in conjunction with other present or future technologies.

The present invention relates to a protective pad that is comprised of an impact shell and a damping component. The damping component may be formed by a plurality of connecting members that are separated from the impact shell by a plurality of extension members. The damping component may additionally or alternatively be formed by a sheet-like form that is separated from the impact shell by a plurality of extension members that extend between the solid sheet and the impact shell. The damping component absorbs a portion of an impact force that is distributed across the damping component by the impact shell. The geometry of the damping component may be configured to provide a desired level of impact attenuation at specific locations of the protective pad. The dampening component may be affixed with the impact shell by way of a coupling frame incorporated along a perimeter of the impact shell. The coupling frame may be overmolded into the impact shell along the perimeter of impact shell and plurality of perforations proximate the perimeter.

Accordingly, in one aspect, the present invention provides a protective pad. The protective pad is comprised of an impact shell having an exterior surface and an opposite interior surface. The impact shell has a perimeter that is defined, at least in part by a medial edge, an opposite lateral edge, a top edge, and an opposite bottom edge. The impact shell further comprises (1) a plurality of perforations extending from the exterior surface to the interior surface around proximate one or more portions of the perimeter, of the impact shell; and (2) a coupling frame surrounding at least a portion of the perimeter and extending through the plurality of perforations of the impact shell. The protective pad is comprised of a damping lattice positioned proximate the interior surface of the impact shell and affixed to the coupling frame. The damping lattice is formed of an elastomeric material. The damping lattice is comprised of (1) a plurality of interconnected joining members having an outer surface and an opposite inner surface; and (2) a plurality of extension members extending beyond the inner surface towards the interior surface of the impact shell.

In another aspect, the present invention provides a protective pad comprising an impact shell formed from a first material. The impact shell comprised of an exterior surface and an opposite interior surface. The interior surface of the impact shell has a curved profile extending outwardly in a direction of the outer surface from the medial edge to the lateral edge. The impact shell is further comprised of a perimeter defined, at least in part, by a medial edge, an opposite lateral edge, a top edge, and an opposite bottom edge. Additionally, the impact shell is further comprised of a plurality of perforations around the perimeter of the impact shell.

In this example, the protective pad is further comprised of a damping lattice positioned proximate the interior surface of the impact shell. The damping lattice is formed of a second material that is different from the first material. The damping lattice is comprised of: (1) a plurality of interconnected joining members having an outer surface and an opposite inner surface; (2) a plurality of voids extending between the outer surface and the inner surface formed by the plurality of joining members; and (3) a plurality of extension members extending between the inner surface of the damping lattice and the interior surface of the impact shell. The protective pad is further comprised of a coupling frame surrounding at least a portion of the impact shell perimeter and passing through the plurality of perforations from the exterior surface to the interior surface. The coupling frame is formed from a second material. The damping lattice affixed to the impact shell by way of the coupling frame.

A third aspect of the present invention also provides a protective pad comprising a rigid impact shell having an exterior surface and an opposite interior surface curved between a medial edge and an opposite lateral edge. The impact shell further comprising a plurality of perforations around a perimeter of the impact shell. The plurality of perforations configured for receiving a coupling frame encompassing the plurality of perforations such that the coupling frame formed of a thermoplastic elastomer overmolded on to the impact shell. The coupling frame encompasses the plurality of perforations by passing through the perforations from the exterior surface to the interior surface of the impact shell. The protective pad is further comprised of a damping lattice that is coupled to the interior surface of the rigid impact shell at the coupling frame. The damping lattice is formed of the same thermoplastic elastomer as the coupling frame. The damping lattice is comprised of (1) a plurality of interconnected joining members having an outer surface and an opposite inner surface; (2) a plurality of cylindrically-shaped extension members, such that each of the plurality of cylindrically-shaped extension members extend from the inner surface of the interconnected joining members to a distal end.

Having briefly described an overview of embodiments of the present invention, a more detailed description follows.

The protective pad is contemplated as providing protection to one or more portions of a body or object. For example, it is contemplated that a protective pad implementing one or more aspects provided herein may be utilized to provide protection and/or force damping functions to a variety of body parts. Examples include, but are not limited to, shin guards, knee pads, hip pads, abdominal pads, chest pads, shoulder pads, arm pads, elbow pads, and implementation in the protection of the head (e.g., helmets). Additionally, it is contemplated that this concept is utilized on inanimate objects (e.g., posts, walls, vehicles). Therefore, it is contemplated that aspects provided herein may be useful in a variety of situations at a variety of locations.

A protective pad, as provided herein, is an article for reducing an effect of an impact force on an associated portion of a wearer. For example, a shin guard utilizing features discussed herein may reduce the perception of energy imparted on the shin region of a user through the use of the protective pad. This change in perception may be accomplished in a variety of ways. For example, the energy applied at a point of impact may be distributed over a greater surface area, such as through a rigid impact shell. Further, it is contemplated that a dissipating/absorbing material may provide a compressive function for absorbing and/or dissipating a portion of the impact force. Traditionally, a foam material may be used to provide this absorption-type functionality. However, foam-like material may have several disadvantages, such as poor response to washing (e.g., tendency to break down or otherwise lose protective qualities with repeated washes), the inability to transfer moisture and air from an inner surface to an outer surface, and weight issues.

Therefore, aspects of the present invention look to provide at least some of the advantages of a protective pad (e.g., energy distribution and energy absorption) while reducing some of the disadvantages associated with a traditional protective pad.

FIG. 1 illustrates an exemplary protective pad 100 in accordance with aspects of the present invention. For example, the protective pad 100 is depicted as a shin guard in an as-worn position on a leg of a wearer. In this example, the shin guard protective pad 100 has a top edge 110, a bottom edge 112, a lateral edge 108, and a medial edge (not visible as depicted). The protective pad 100 curves from the medial edge to the lateral edge 108 to form a curved outer (and interior) surface about the wearer's shin region of her leg.

The protective pad illustrated in FIG. 1 is further comprised of a first strap 114 and a second strap 116. As will be discussed in greater detail with respect to FIG. 18, the straps may be formed as part of the damping component. Further, it is contemplated that the straps may extend from a first side (e.g., medial side) and couple on an opposite side (e.g., lateral side). The coupling of the strap may occur with the impact shell 101 and/or a portion of the damping component.

While the protective pad 100 of FIG. 1 is depicted as being secured to the wearer's leg utilizing a plurality of straps, it is contemplated that an alternative securing mechanism may be implemented. For example, the protective pad may be maintained in a position by a pocket in other articles of clothing, permanently/temporarily coupled to one or more other articles (e.g., pants, socks, shirt, and girdle), temporary adhesives, sleeve-like articles, and the like. As will be discussed hereinafter, an ability of the protective pad 100 to move (e.g., slide, shift, compress, deform) slightly with an impact force may provide advantages achieved by aspects discussed herein; therefore, it is contemplated that a securing mechanism may allow for that type of movement.

Figure 2:
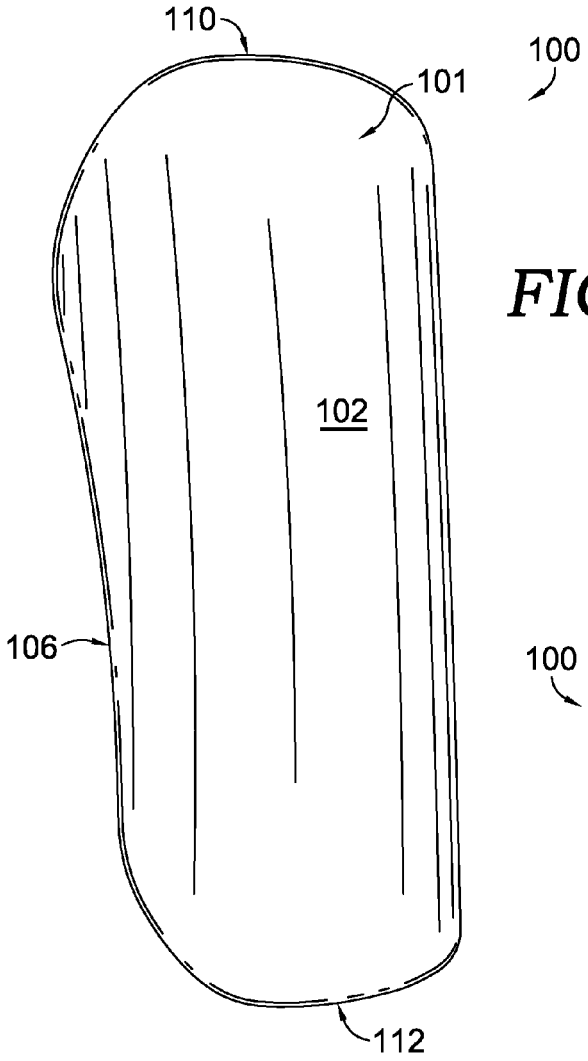
FIG. 2 depicts a medial perspective view of the protective pad, in accordance with aspects of the present invention.

FIG. 2 depicts a medial perspective view of the protective pad 100, in accordance with aspects of the present invention. In particular, an impact shell 101 is depicted. The impact shell 101 provides at least a distributive function (among other functions) to the protective pad 100. For example, the impact shell 101 is contemplated as being formed from a rigid material, such as a polymer (e.g., polypropylene, woven polypropylene, polyethylene, polystyrene, polyester, polycarbonate, polyamide, and the like), carbon fiber, metals (e.g., aluminum, titanium), natural materials (e.g., bamboo), and other materials. Further, it is contemplated a plurality of materials may be used in the formation of the impact shell 101. For example, lamination of sheet-like materials may form an impact shell with a variety of characteristics. Additionally, it is contemplated that various regions of a shin guard may be formed by different materials (e.g., along a centerline a denser portion/type of material than along the perimeter regions). Further, it is contemplated that multiple independent portions may, in combination, form the impact shell. Each of the independent portions may be formed from one or more materials that may be similar or different.

The impact shell 101 is depicted in this example as having a curved exterior surface 102 that curves from the medial edge 106 to a lateral edge. In an exemplary aspect, the interior surface (not depicted) curves in a near parallel manner as the exterior surface 102 (outer surface). However, it is contemplated that based on a varied thickness of the impact shell 101 along the length of the curve, the interior and the exterior surface 102 may not be parallel (e.g., have a common radius). Further, in an exemplary aspect, a consistent curved profile is not achieved across the length extending between the medial edge 106 and a lateral edge based on the organic shape of the underlying body part when in an as-worn position. Therefore, when discussed herein, the curved nature of the impact shell (and the damping component to be discussed hereinafter) is not limited to a continuously constant curve, but instead to the general curve-like aspect implemented to protect an underlying portion of a wearer.

Figure 3:
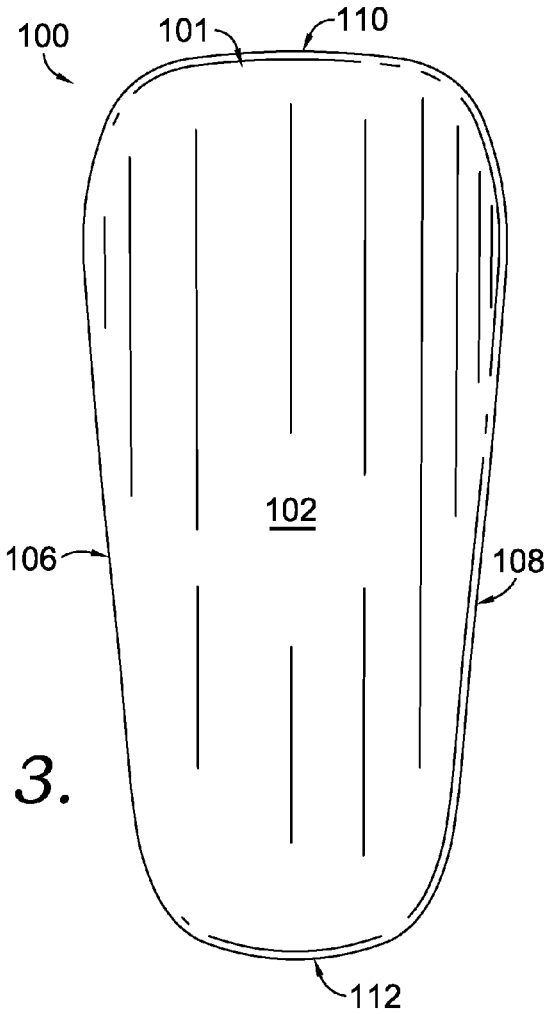
FIG. 3 depicts a front perspective view of the protective pad, in accordance with aspects of the present invention.

FIG. 3 depicts a front perspective view of the protective pad 100, in accordance with aspects of the present invention. The protective pad 100 is depicted with the exterior surface 102 of the impact shell 101 forward facing. The impact shell 101, as previously discussed, has a perimeter defined, at least in part, by the top edge 110, the lateral edge 108, the bottom edge 112, and the medial edge 106. As used herein, the terms medial and lateral are relative terms that merely are intended to convey a concept of a first side edge and a second side edge. This terminology is used to bring awareness to the mirror-imaging that may be used for a protective pad intended for use on a left portion (e.g., left leg) of the body and a protective pad intended for use on a right portion (e.g., right leg) of the body.

While not depicted, it is contemplated that the impact shell (and/or other portions of the protective pad) may be formed from two or more portions. For example, it is contemplated that a first portion forms a lateral portion and a second portion forms a medial portion of the impact shell. The two portions may be flexibly coupled using one or more materials and/or mechanisms. In an exemplary aspect, it is contemplated that an underlying damping component may form at least a portion of a coupling mechanism to maintain the first portion and the second portion in a desired relative orientation. Further, it is contemplated that a first portion may be formed from a first material and a second portion may be formed from a second material. For example, a location on a protective pad that demands a greater reliance to impact forces may be formed from a first material that is more reliant, but more dense than a second material forming a second portion in a less prone to impact location. It is contemplated that materials, sizes, and locations may be adjusted to achieve a variety of benefits, such as durability, weight savings, ventilation, and the like.

Figure 4:
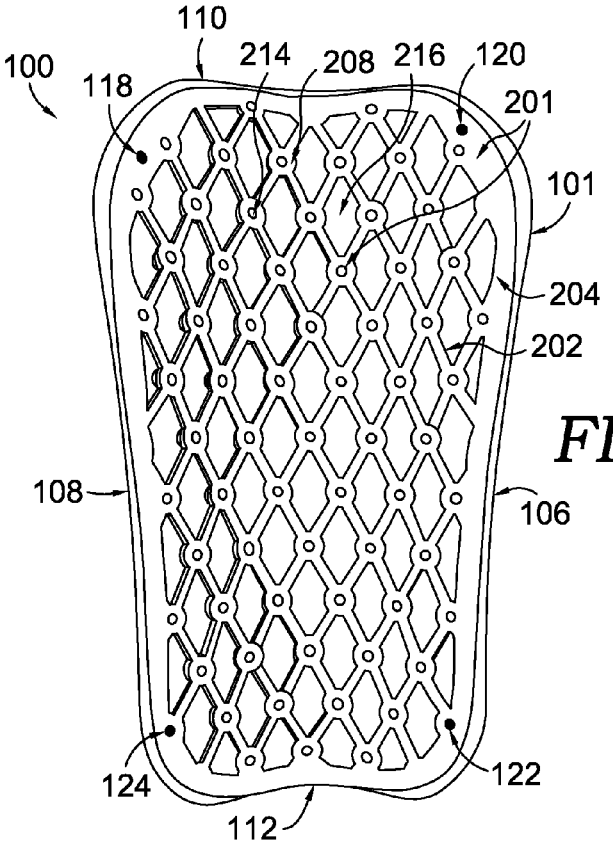
FIG. 4 depicts a back perspective of the protective pad, in accordance with aspects of the present invention.

FIG. 4 depicts a back perspective of the protective pad 100, in accordance with aspects of the present invention. In this example, a damping component 201 is illustrated. The damping component 201 is comprised of a plurality of joining members 202 forming a network of interconnected members that, in combination, form a lattice-like structure. For example, a mesh-like geometric pattern may be formed by the joining members. Various geometric configurations of joining members will be discussed in closer detail hereinafter with respect to FIGS. 7-10.

An exemplary damping component 201 provides a damping effect for an impact force experienced by the impact shell 101. For example, the damping component 201 may absorb and/or dissipate some of the impact energy prior to its being transferred to the wearer of the protective pad 100. This damping, dissipation, and/or absorption effect may be accomplished through a variety of characteristics. For example, it is contemplated that an elastomeric material forms the damping component 201 in an exemplary aspect. An elastomeric material may include a thermoplastic elastomer, a thermoset elastomer, rubber, synthetic rubber, and other materials that demonstrate a low Young's modulus and a high yield strain. Examples of elastomer material include, but are not limited to, a GLS 311-147 thermoplastic elastomer available from the PolyOne Corporation of Avon Lake, Ohio. An exemplary elastomer may exhibit a tensile strength (yield, 23° C.) ranging from 0.8-8.7 MPa, a Shore Hardness (A) of 16-56, and an elongation at break (@23° C.) of up to 1200% (e.g., about 1000%, 800%,). However, while exemplary ranges are provided, it is contemplated that additional materials exhibiting characteristics greater than or less than one or more of the provided ranges in one or more of the provided characteristics may also/alternatively be utilized. Further, alternative materials are contemplated.

In addition to dissipating, damping, and/or absorbing impact energy through a material selection, a geometric organization of the joining members may also facilitate reducing a perceived impact force. As will be discussed hereinafter with respect to FIGS. 7-10, the thickness, length, void size, and void geometry may all affect the perceived level of impact energy. For example, longer joining members forming the lattice structure may result in a "looser" lattice that is more flexible and less resistant to deformation. Similarly, a diamond-shaped void between the joining members may be more susceptible to deformation in a skewing direction than a triangle-like void. The skewing of the lattice may be more effective for absorbing off-axis impact forces (e.g., tangential impacts to the impact shell). Additionally, the thicker the joining members forming the damping lattice, the more resistant to deformation the damping component may be (and therefore providing less damping characteristics as perceived by a wearer). Additionally, as will be discussed, the offset of an extension member, the cross-sectional shape of an extension member and the size/shape of an extension member void may all affect a perceived level of impact force.

The damping component 201 of FIG. 4 depicts an outer surface 204 formed by a plurality of interconnected joining members 202. The joining members 202 may be formed in a common manufacturing process, such as injection molding, such that the joining members as-a-whole form a lattice network of the damping component 201. The joining members 202 define a plurality of voids, such as a void 216. The void 216 extends through the outer surface 204 and an inner surface 206 (not identified) of the joining members. For example, when two or more joining members form a two-dimensional shape, which may be organic in nature and/or linear in nature, that internal void not occupied by a portion of one of the members is an exemplary void.

At an intersection of two or more joining members an extension member 208 may be located (but not in all aspects), as will be discussed in greater detail with respect to FIG. 5 hereinafter. Further, associated with one or more extension members, an extension member void 214 may extend through the extension member and the joining member outer surface 204. Similar to the extension member, the extension member void will be discussed in greater detail hereinafter.

The outer surface 204 forms a user-contacting surface, in an exemplary aspect. For example, when in an as-worn position, the outer surface 204 may be user contacting (e.g., positioned adjacent to the user's body). However, it is contemplated that one or more additional articles (e.g., sock, pant leg, sleeve, lining, water absorbing materials, adhesives, tacky materials, and the like) may be disposed between the outer surface 204 and the wearer's body when in an in-use position. Therefore, the term "user-contacting surface" is generally descriptive of a direction of orientation when in an as-used state, but not limiting to requiring direct user contact.

As depicted in FIG. 4, the damping component 201 may generally conform to the interior surface of the impact shell 101 geometry. For example, if the interior surface of the impact shell 101 has a curved profile, the damping component 201, when coupled to the interior surface, assumes a similar curved profile. However, it is contemplated that one or more geometric attributes of the damping component 201 may introduce a different profile (e.g., variable offsets by extension members, variable joining member thickness, points of coupling between the damping component and the interior surface), as will be discussed in FIG. 14 hereinafter.

An extension member 208 may extend from the inner surface (206 in FIG. 6) of the damping component 201 outwardly toward the inner surface (104 in FIG. 6) of the impact shell 101. An extension member void may extend through at least a portion of the extension member. For example, an extension member void 214 is a cavity of space that passes through the outer surface of the damping component 201 through the offset length of the extension member and out the distal end of the extension member. However, it is contemplated that an extension member void may only extend a portion of the extension member and/or connecting member. Further, it is contemplated that the extension member void may not be present in one or more extension members. As with the extension members, it is contemplated that an extension member void may have any shape, size, and/or orientation. For example, it is contemplated that an extension member void may have a similar cross-sectional shape to an associated extension member. Additionally, it is contemplated that an extension member void may have a different cross-section shape from an associated extension member. Examples of cross sectional shapes include, but are not limited to, circle, oval, rectangular, organic in nature, star-like, triangular, or any other shape.

An extension member void may provide enhanced impact attenuation characteristics through the introduction of crumple zone-type functionality. For example, the inclusion of a void-like space provides an area in which a portion of the damping component 201 (extension member and/or connecting member) may deform to absorb an impact force. Further, it is contemplated that the inclusion of the extension member voids may provide a mass reduction option that enhances the usability and desirability of the resulting protective pad. Further yet, it is contemplated that an extension member void may provide a channel through which a bonding agent is introduced to the impact shell for maintaining the impact shell and damping component in a coupled state.

FIG. 4 also depicts four exemplary coupling points 118, 120, 122, and 124. The coupling points may include locations at which the damping component is coupled to the impact shell. For example, it is contemplated that the coupling points may represent points of a bonding agent, ultrasonic welding, mechanical fasteners, compression fittings, protrusions extending through the impact shell, and the like. While four exemplary coupling points are depicted, it is contemplated that any number and/or location of coupling points may be utilized. Further, it is contemplated that the coupling points are instead coupling areas that span in a variety of shapes, sizes, and directions (e.g., linear, perimeter, shape contoured, and the like).

In an exemplary aspect, the damping component may be coupled with the impact shell at one or more coupling points (or areas) by way of an overmold process. For example, it is contemplated that a material (e.g., TPE) different from the impact shell may be overmolded to the impact shell in an area at which the damping component is to be coupled. For example, it is contemplated that an inner surface of the impact shell may be overmolded with a TPE film (or any material suitable for coupling with the damping component). The damping component, which may be formed from a TPE material, may then be ultrasonically welded to the TPE film of the impact shell. The TPE film may provide a material to which the damping component may be coupled when the underlying impact shell material is less capable.

Figure 5:
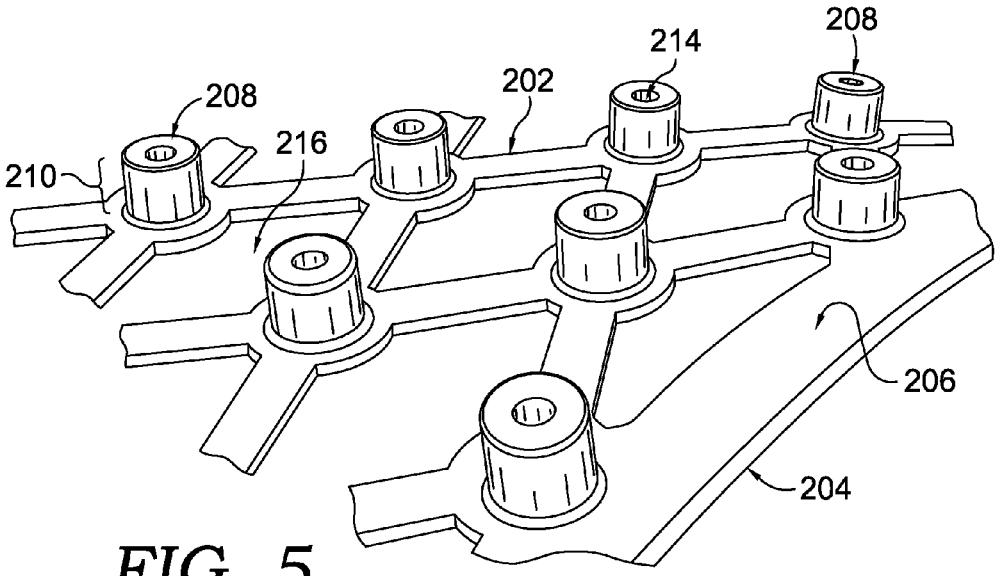
FIG. 5 depicts a perspective view of the damping lattice, in accordance with aspects of the present invention.

FIG. 5 depicts a perspective view of the damping component formed with a lattice, in accordance with aspects of the present invention. The inner surface 206 is exposed along with a number of exemplary extension members 208, extension member voids 214, and voids 216 between joining members 202. Also illustrated is the concept of an offset 210. The offset 210 is the length that an extension member extends from the inner surface 206. This offset distance may form a compressible void between the connecting members of the damping lattice and the impact shell. While the extension members 208 are depicted as having a cylindrical shape, it is contemplated that any shape may be implemented. For example, a conical shape having a base extending from a lattice or sheet-like form, a conical shape having a distal end formed by the base, a pyramid shape (with a base at any location), a spherical shape, a prismatic shape, a cuboid shape, any-numbered-ahedron shape, and the like. Further, it is contemplated that an organic form may be implemented. A combination of shapes/forms may be utilized in any combination.

Figure 6:
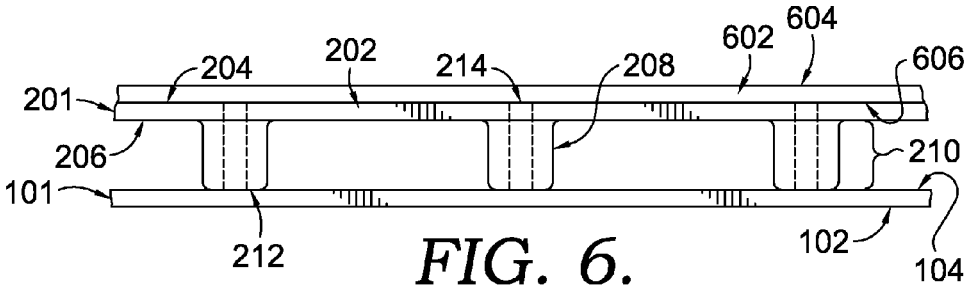
FIG. 6 depicts a profile view of a portion of an exemplary protective pad, in accordance with aspects of the present invention.

FIG. 6 depicts a profile view of a portion of an exemplary protective pad, in accordance with aspects of the present invention. The impact shell 101 is depicted as forming a lower portion of FIG. 6. In an exemplary aspect, the inner surface 104 is coupled, at least in one or more locations, with a distal end 212 of an extension member, such as the extension member 208. As previously discussed, it is contemplated that portions of the damping component 201 that are able to contact the impact shell may not be coupled with the impact shell. For example, it is contemplated that the damping component may be placed under tension (e.g., stretched) across a curved inner surface of the impact shell such that the inner surface curves away from the damping component 201. In this example, the distal ends of extension members 208 may come in contact with the inner surface of the impact shell when an impact force results in sufficient forces to overcome elastic properties of the damping component, which in turn applies additional tension that allows the damping component to stretch and conform, at least in part, to the shape of the impact shell. Further, it is contemplated that portions of the damping component other than the distal ends couple with the impact shell (e.g., a perimeter element, an extension member protrusion).

The extension member 208 is depicted as extending from the inner surface 104 of the impact shell 101 to the inner surface 206 formed by the joining members 202 of the damping component 201. Also depicted are the extension member voids 214 extending through the entire thickness of the damping component 201. Further, it is contemplated that a void may also extend through the impact shell such that a ventilation channel is formed. A void (not depicted) extending through the impact shell 101 may correspond to an extension member void and/or it may not correspond (e.g., not align) with an extension member void and instead provide a mass reduction and/or ventilation option from the exterior surface 102 to the inner surface 104.

The offset 210 is depicted as remaining consistent among the illustrated extension members. However, it is contemplated that an offset distance may vary with particular extension members, as will be discussed with respect to FIG. 14 hereinafter.

While a thickness between the exterior surface 102 and the inner surface 104 is depicted as remaining constant for the impact shell 101, it is contemplated that thickness may vary. Further, while a contiguous material is depicted as forming the impact shell 101, it is contemplated that multiple materials may also be used. Similarly, the thickness extending between the outer surface 204 and the inner surface 206 of the damping component 201 is depicted as remaining constant. However, it is contemplated that the thickness may vary with location. Further, the extension members 208 are depicted having substantially parallel profile sides; however, it is contemplated that any relative orientation may be used (e.g., tapered profile allowing for an increasing resistance to compression with distance of deflection).

As will be discussed in additional detail in FIGS. 27-28 hereinafter, it is contemplated that a skin layer 602 may be affixed to the outer surface 204 of the damping component 201 on one or more portions of the damping component 201 (as will be depicted in FIG. 28 hereinafter). The skin layer 602 has an outer surface 604 and an inner surface 606. The outer surface 604 is a skin-contacting (e.g., wearer-contacting) surface in an exemplary as-worn aspect.

The skin layer 602 may be a thin layer or film applied to the outer surface 204 to provide a more appealing skin contacting surface for a wearer when in an as-worn position. For example, it is contemplated that the skin layer may be formed from a thermoplastic elastomer (TPE). Examples of generis classes of TPEs include styrenic block copolymers, polyolefin blends, elastomeric alloys (TPE-v or TPV), thermoplastic polyurethanes, thermoplastic copolyester, and thermoplastic polyamides. Additionally, it is contemplated that the skin layer may be formed from a flocking process or from alternative laminates, decals, and materials.

Figure 7:
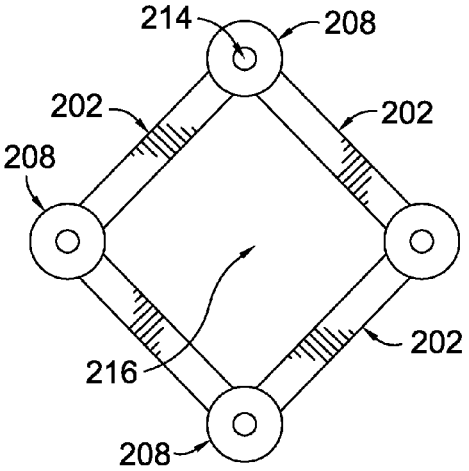
FIG. 7 depicts a damping lattice configuration having commonly sized extension member and extension member voids at each intersection of connecting members, in accordance with aspects of the present invention.

FIGS. 7-13 depict exemplary configuration for extension members, extension member voids, and connecting members of a damping component, in accordance with aspects of the present invention. In particular, FIG. 7 depicts a diamond-like joining member 202 (connecting member) configuration having commonly sized extension members 208 and extension member voids 214 at each intersection of connecting members, in accordance with aspects of the present invention. The resulting void 216 is a rectangular-shaped void having four primary edges defined by the joining members 202.

Figure 8:
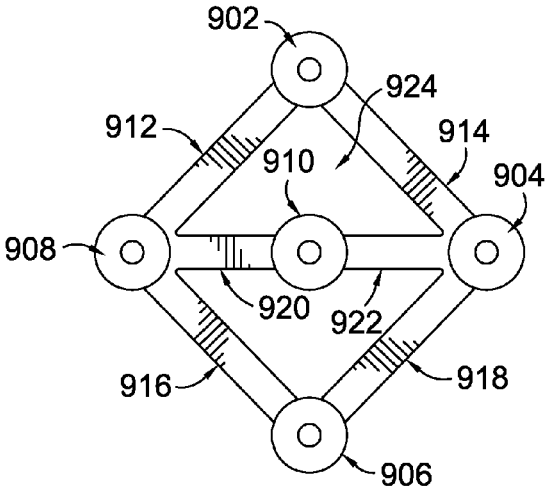
FIG. 8 depicts a damping lattice configuration comprised of four similarly sized connecting members, in accordance with an exemplary aspect of the present invention.

FIG. 8 depicts a damping lattice configuration comprised of four similarly sized connecting members 912, 914, 916, and 918, in accordance with an exemplary aspect of the present invention. Further, similarly sized/shaped extension members (902, 904, 906, and 908) are located at the intersections of the similarly-sized connecting members. The damping lattice is also comprised of two additional connecting members 920 and 922 that extend from the extension members 908 and 904. The connecting members 920 and 922 are joined at a location identifiable by an extension member 910. As a result of the above configuration, a triangular void 924 is formed between the connecting members 912, 914, 920, and 922. The triangular void may provide greater resistance to deformation in a lateral direction (e.g., a tangential impact to the protective pad) as a result of inherent geometric characteristics of a triangle compared to a rectangular shape.

While two connecting members 920 and 922 are illustrated, it is contemplated that a single connecting member may span the distance between the extension members 904 and 908. Similarly, it is contemplated that an extension member may be located at any position along one or more connecting members. Further, while connecting members are discussed as discrete elements, it is contemplated that connecting members of a damping lattice are a contiguously formed element without discrete portions.

Figure 9:
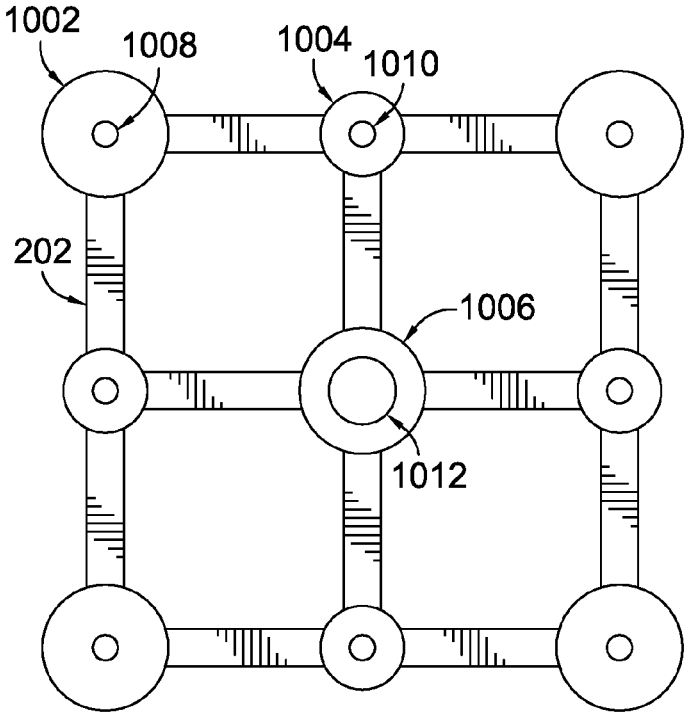
FIG. 9 depicts a damping lattice configuration comprising multiple sized extension members and extension member voids, in accordance with aspects of the present invention.

FIG. 9 depicts a damping lattice configuration comprising multiple sized extension members and extension member voids, in accordance with aspects of the present invention. For example, it is contemplated that a damping lattice is comprised of a first extension member 1002, a second extension member 1004, and a third extension member 1006. The first extension member 1002 and the second extension member 1004 share a common cylindrical shape, but of a different diameter. The first extension member 1002 has a larger diameter than the second extension member 1004. In an exemplary embodiment, the first extension member may provide a greater resistance to compression based on the larger diameter; therefore, it may be suitable for locations on a protective pad where such characteristics are desired (e.g., edges, near bone structures, near soft-tissue structures, near anticipated points of impact). Conversely, the second extension member 1004 may be desired in a location in which a great degree of relative impact absorption is desired. Both the first extension member 1002 and the second extension member 1004 share similarly sized extension member voids 1008 and 1010. Further, it is contemplated that an extension member void depth may also vary without affecting a cross-section size.

The third extension member 1006 is sized similar to the first extension member 1002. However, an extension member void 1012 of the third extension member 1006 is larger in size relative to the extension member voids 1008 and 1010. A larger extension member void may provide a greater volume of space for deformation of the extension member, which may result in a greater degree of impact force absorption.

It is understood that the size, shape, and combination of elements (i.e., connecting members, extension members, and extension member voids) may be in any order, fashion, and/or relationship. Therefore, while specific examples have been illustrated, it is contemplated that any combination of those elements may be used in connection with one another to form one or more portions of a damping component.

Figure 10:
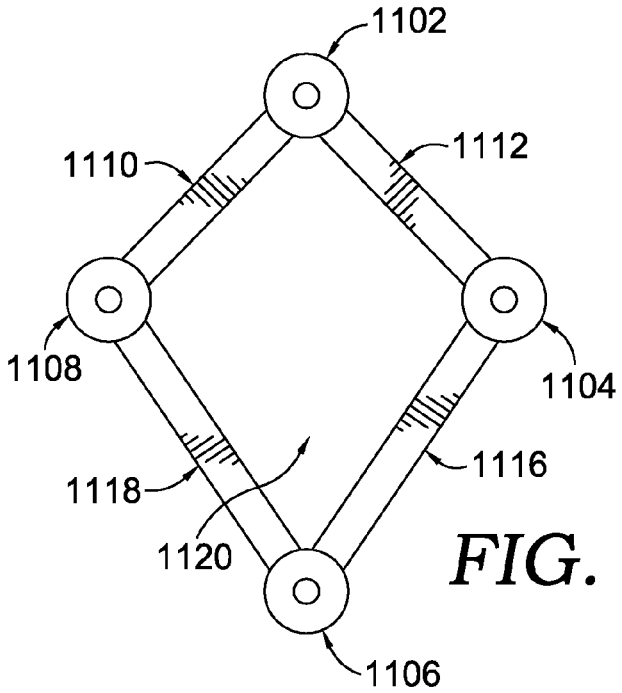
FIG. 10 depicts a damping lattice configuration comprised of a plurality of connecting members and a plurality of extension members, which in combination form a void, in accordance with aspects of the present invention.

FIG. 10 depicts a damping lattice configuration comprised of a plurality of connecting members (1110, 1112, 1116, and 1118) and a plurality of extension members (1102, 1104, 1106, and 1108), which in combination form a void 1120, in accordance with aspects of the present invention. In this exemplary configuration the connecting members 1118 and 1116 are of a similar length that is longer than the connecting members 1110 and 1112. As a result, the void 1120 is a diamond-like shape.

Figure 11:
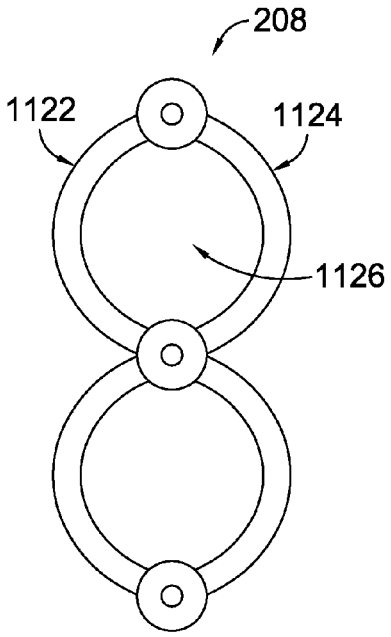
FIG. 11 depicts a damping lattice configuration comprised of curved connecting/joining members, in accordance with an exemplary aspect of the present invention.

FIG. 11 depicts a damping lattice configuration comprised of curved connecting/joining members, in accordance with an exemplary aspect of the present invention. In particular, FIG. 11 depicts two connecting members 1122 and 1124 extending from an extension member 208 to terminate at another extension member, which results in a void 1126. The void 1126 is defined, at least in part, by the curved connecting members. While the connecting member 1122 is depicted as having a minor-image curve to the connecting member 1124, it is contemplated that any shape (e.g., linear, organic, or any combination) may be used. Further, as will be discussed with respect to FIG. 13 hereinafter, it is contemplated that combinations of linear and organic shaped connecting members may be used concurrently. As with the other void shapes and connecting member shapes discussed herein, it is contemplated that any size, orientation, and ultimate shape may be implemented in any combination at any location to achieved desired damping results, such as impact force attenuation.

Figure 12:
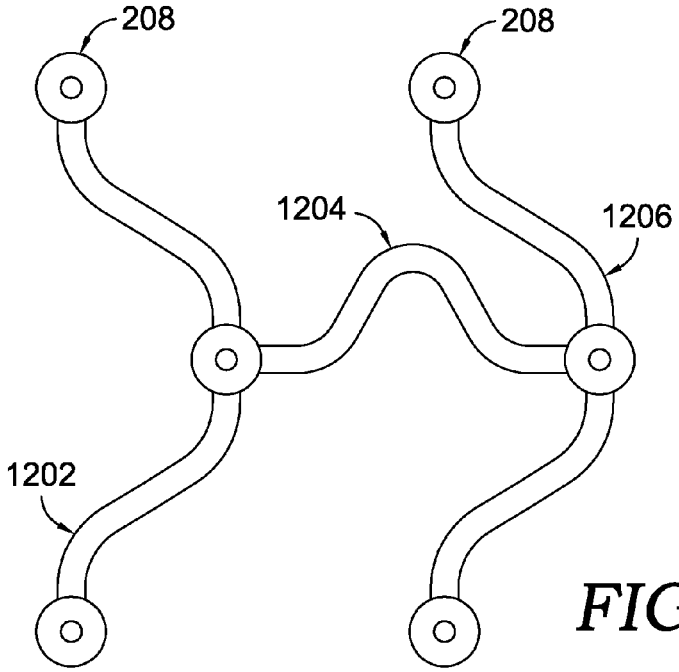
FIG. 12 depicts a damping lattice configuration comprised of organic shaped connecting members, in accordance with an exemplary aspect of the present invention.

FIG. 12 depicts a damping lattice configuration comprised of organic shaped connecting members, in accordance with an exemplary aspect of the present invention. FIG. 12 is comprised of a plurality of various shapes and sizes of connecting members, such as connecting members 1202, 1204, and 1206. While a linear connecting member may be utilized to extend from a first extension member to a second extension member, it is contemplated that an organic connecting member, such as the connecting member 1202, incorporates one or more curves, bends, or other variations that may extend the length of the connecting member beyond a pure linear aspect. The addition of organic forms may provide additional damping properties by allowing additional movement in the damping lattice upon impact.

While not depicted in the figures explicitly, it is contemplated that an extension member may be represented as an increase in the thickness of the connecting members relative to a thickness at a different location along the connecting member. For example, it is contemplated that along the connecting member 1204 the depth increases at a portion, such as the middle of the upwardly curved center portion to effectively form an offset as previously discussed with respect to the offset 210 of FIG. 6. Stated differently, a change in thickness of a connecting member allows for at least a portion of the inner surface of the connecting member to be offset from an inner (i.e., closest) surface of the impact shell.

Figure 13:
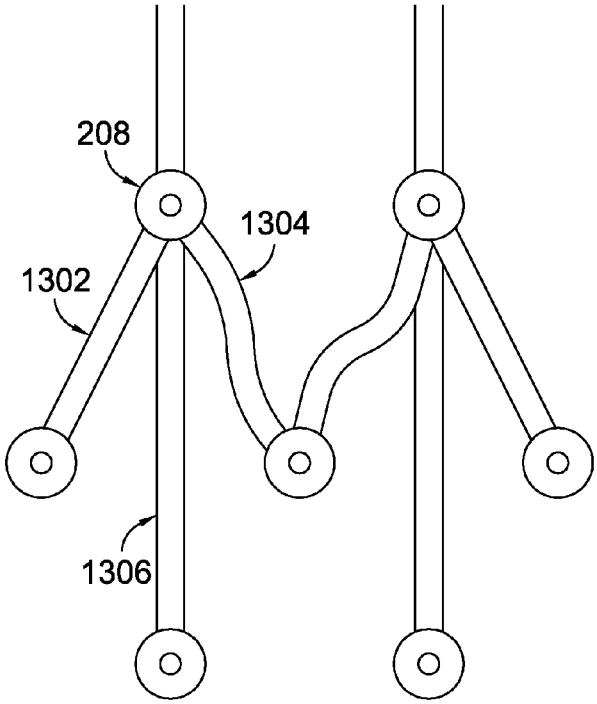
FIG. 13 depicts a damping lattice configuration comprised of organic-shaped and linearly-shaped connecting members, in accordance with an exemplary aspect of the present invention.

FIG. 13 depicts a damping lattice configuration comprised of organic-shaped and linearly-shaped connecting members, in accordance with an exemplary aspect of the present invention. In particular, FIG. 13 illustrates that different connecting member lengths and shapes may be used in combination. For example, a connecting member 1302 is linear in shape, but extends a similar ultimate length as a connecting member 1304 that is more organic in shape. Similarly, it is contemplated that yet an additional connecting member 1306 may extend a greater distance from a common extension member 208. Further, it is contemplated that any width, thickness, length, shape, cross-sectional shape, material, color, and combinations thereof may be implemented in exemplary aspects of a damping lattice.

Figure 14:
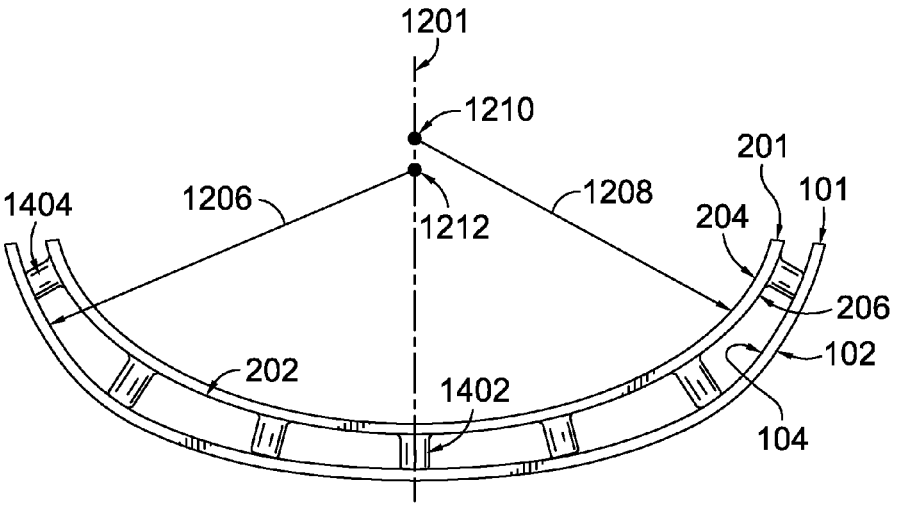
FIG. 14 depicts a top edge toward bottom edge view of a protective pad portion, in accordance with aspects of the present invention.

FIG. 14 depicts a top edge toward bottom edge view of a protective pad portion, in accordance with aspects of the present invention. The protective pad is comprised of the impact shell 101 and the damping component 201. In this example, the impact shell 101 curves outwardly towards an exterior surface 102. The curve of the impact shell may be defined by a radius 1206 extending from an imaginary point 1212 on an axis 1201.

The damping component 201 may be formed such that it is comprised of extension members giving different offset distances. For example, a first offset 1402 may be greater than a second offset 1404. Depending on the impact shell shape, this variation in offset may be introduced to provide a consistent curved outer surface 204 of the damping component (e.g., compensating for an irregular curved impact shell). Alternatively, the variations in offset distances may be used to introduce an irregular curved profile on the outer surface 204 of the damping component 201 to better form to an organic shape of a wearer. Further, it is contemplated that the offset distance may be altered to achieve desired impact attenuation characteristics at strategic locations (e.g., along soft tissue contact areas, along bone regions).

Further, as depicted in FIG. 14, it is contemplated that as opposed to the impact shell 101 and the damping component 201 sharing a common curve center, an offset center (e.g., 1212 and 1210) may be utilized. In an exemplary aspect, the offset center is commensurate with an offset length of an extension member (e.g., 1202). In yet another exemplary aspect, a radius 1208 of the damping component 201 may vary with location. For example, the radius may increase as it rotates at a greater angle of deflection from the axis 1201. In this example, the offset 1402 may be larger than the offset 1404, when the radius 1206 changes a smaller amount (if at all) for a comparable angle of deflection.

Consequently, variations in connecting members, extension members, extension member voids, voids, offsets, curved profiles, materials, and the like may all contribute to a variety of contemplated aspects of a protective pad comprised of an impact shell and a damping component. Although the protective pad construction is described above by referring to particular embodiments, it should be understood that the modifications and variations could be made to the protective pad construction described without departing from the intended scope of protection provided by the following claims.

Figure 15:
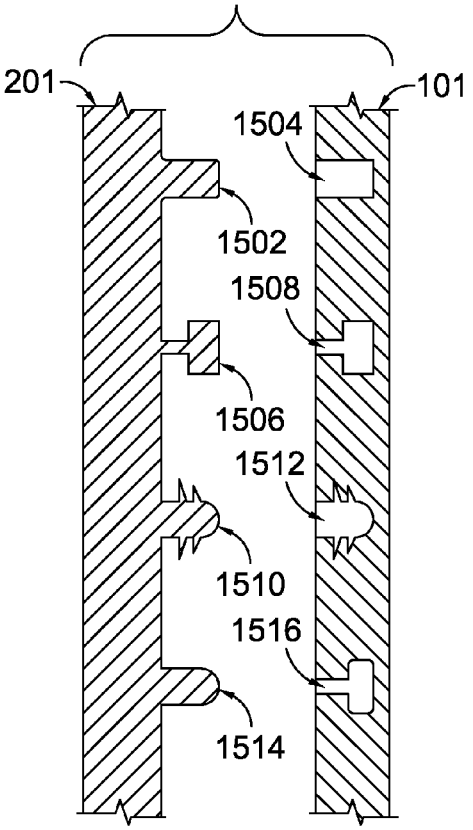
FIG. 15 depicts exemplary protrusions on a damping lattice for mating with exemplary channels in an impact shell for coupling the portions, in accordance with aspects of the present invention.

FIG. 15 depicts exemplary protrusions on a damping component for mating with exemplary channels in an impact shell for coupling the portions, in accordance with aspects of the present invention. As previously discussed, the damping component 201 may be coupled with the impact shell 101 through a variety of different mechanisms and means. For example, as depicted in FIG. 15, it is contemplated that one or more channels may be formed in the impact shell 101 that are functional for receiving one or more protrusions extending from the damping component. The channels may extend along a perimeter portion of the impact shell 101, along an interior portion of the impact shell 101, or any other portions of the impact shell, such as an inner surface of the impact shell. The length, shape (both cross-section and along the surface of the impact shell), size, and location may vary and are contemplated as including a range of options. For example, it is contemplated that a first channel having a first shape may extend along a first portion of the impact shell and a second channel having a different size, shape, and/or length may extend along or through a second portion of the impact shell.

Examples of different channels are depicted in FIG. 15. For example, a rectangular cross-section channel 1504, a 'T'-shaped cross-section channel 1508, a barbed cross-section channel 1512, and an expansion 'T'-shaped cross-section channel 1516 are provided. It is contemplated that additional forms may be implemented in exemplary aspects.

Examples of different protrusions are depicted as extending from the damping component. For example, a rectangular cross-section protrusion 1502, a 'T'-shaped protrusion 1506, a barbed protrusion 1510 and a rounded protrusion 1514 are provided.

Different combinations of protrusions and channels may provide different functional advantages. For example, the rectangular protrusion 1502 and rectangular channel 1504 may be adapted to prevent lateral movement between the damping component and the impact shell while still allowing for a decoupling aspect. The 'T'-shaped protrusion 1506 and the 'T'-shaped channel 1508 may provide a high resistance to decoupling by forces non-parallel to the channel. However, this arrangement may still allow for the decoupling of the damping component from the impact shell by a sliding action that guides the protrusion through the channel. The rounded protrusion 1514 may be adapted for expanding/compressing to fill a portion of the receiving channel, such as the barbed cross-section channel 1512 or the 'T'-shaped cross-section channel 1516. In this example, the rounded protrusion may compress in portions to expand into the barb-like extensions of the receiving channel 1512. Similarly, the rounded protrusion 1514 may ultimately take on a 'T'-like shape as it is compressed into the receiving channel form 1516. This compressive type fit may provide resistance to decoupling between the damping component and the impact shell.

While the discussion is focused on the protrusions extending from the damping component and the channels formed in the impact shell, it is contemplated that one or more protrusion may extend from the impact shell and one or more channels may be formed in the damping component. Further, it is contemplated that protrusions are integrally formed with the base material from which they extend (e.g., damping component material). Additionally, it is contemplated that the protrusions are formed from a different material or during a different process.

Figure 16:
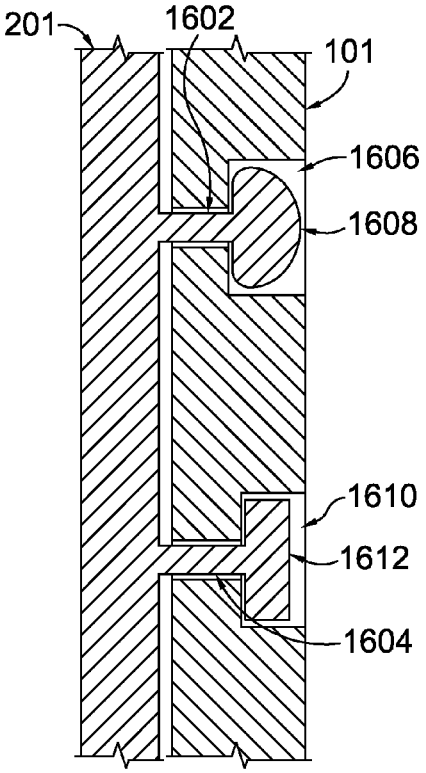
FIG. 16 depicts exemplary protrusions on a damping lattice for serving as a coupling member through one or more receiving chambers in an impact shell, in accordance with aspects of the present invention.

FIG. 16 depicts exemplary protrusions on a damping component for serving as a coupling member through one or more receiving chambers in an impact shell, in accordance with aspects of the present invention. As opposed to a channel extending for a length, the receiving chambers 1606 and 1610 are cavities within the receiving material that allow for the maintaining of a received protrusion 1608 and/or 1612, which may be likened to a rivet-like connection in some examples. For example, the receiving chamber 1606 may allow for a recessed integration of the protrusion 1608 as it extends through the impact shell 101 from the damping component 201. To maintain a coupled relationship, the protrusion 1608 is formed with a stem 1602 having a smaller cross-section than the head of the protrusion. The head, in this example, is rounded to provide an easier insertion through a receiving chamber insertion hole that is then occupied by the stem 1602. While a recessed head is depicted, it is contemplated that a recessed head may not be implemented in an exemplary aspect.

The protrusion 1612 depicts a different cross-section shape at a head portion than the protrusion 1608. A stem portion 1604 extends through a receiving chamber insertion hole to the recessed portion of the receiving chamber 1610. While the recessed portion is depicted as extending to an outer surface, it is contemplated that the receiving chamber may instead be a void within the impact shell that does not extend all of the way to the outer surface, which then may provide the appearance of a uniform outer surface to the impact shell.

As previously discussed with respect to FIG. 15, it is contemplated that the protrusions and the receiving chambers may be formed in either the damping component 201 or the impact shell 101 in exemplary aspects.

Figure 17:
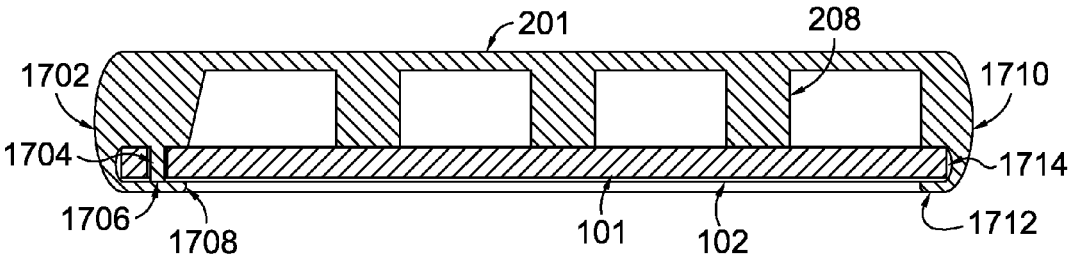
FIG. 17 depicts a cross-section view of a damping lattice coupled with an impact shell utilizing a gasket-like fit along a perimeter, in accordance with aspects of the present invention.

FIG. 17 depicts a cross-section view of a damping component coupled with an impact shell utilizing a gasket-like fit along a perimeter, in accordance with aspects of the present invention. The cross-sectional view of the damping component 201 and the impact shell 101 represents at least two different mechanisms for using a gasket-like coupling. A gasket-like coupling includes the extension of a portion of the damping component 201 from the inner surface of the impact shell 101 to the exterior surface 102. This may be accomplished by a lip portion 1712 that extends along a portion of the damping component, such as the perimeter, to extend around a portion of the impact shell, such as an edge perimeter. The damping component 201 may form a receiving channel 1714 in which the perimeter edge of the impact shell is maintained. In this example, the inner surface of the impact shell may be proximate the inner surface of the damping component and the exterior surface 102 of the impact shell may be proximate the lip portion 1712 along a perimeter portion. As a result, the lip portion encloses a portion of the impact shell to form a coupling bond between the damping component and the impact shell, in this exemplary aspect.

In an additional exemplary aspect, it is contemplated that a protrusion portion 1704 may extend through the impact shell 101 and mate with a lip portion 1708. For example, it is contemplated that a distal end portion of the protrusion portion may be bonded (e.g., welded, tacked, chemically secured) to an inner portion 1706 of the lip 1708. It is also contemplated that the protrusion 1704 may extend through the lip portion 1708 and form a mechanical fastener. Further, it is contemplated that the protrusion 1704 is coupled, either permanently or temporarily, to the impact shell where it extends through the impact shell.

It is contemplated that the protrusion 1704 may be located at any location relative to the impact shell (or the damping component). For example, it is contemplated that the protrusion 1704 (and any number of similar protrusions) may be positioned along a perimeter to pass through the receiving channel 1714 at any location. Additionally, it is contemplated that the protrusion, which may be any shape, size, length, material (similar to and/or different from the damping component), is located at any location.

Figure 18:
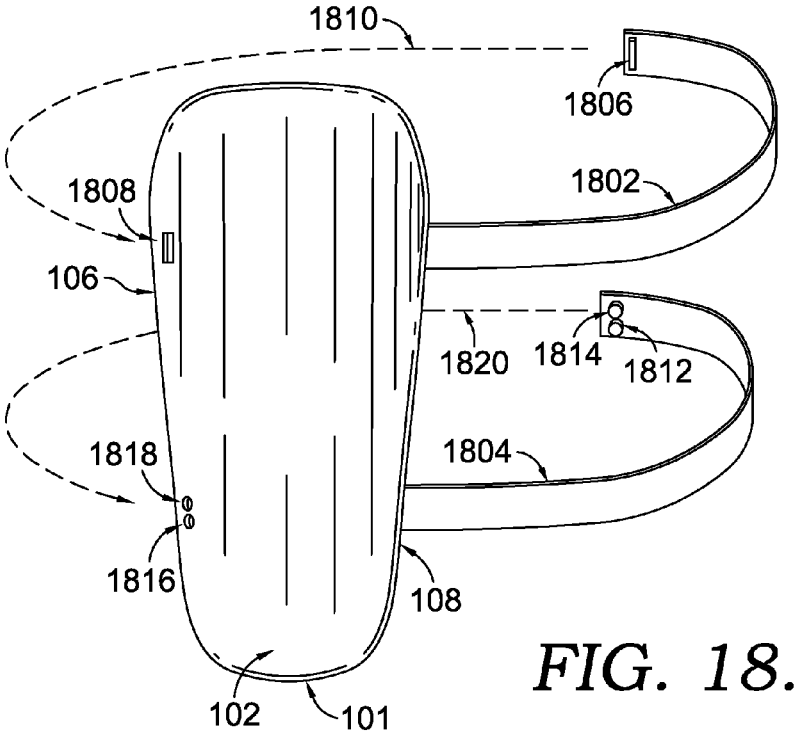
FIG. 18 depicts an exemplary protective pad with damping lattice integrated straps, in accordance with aspects of the present invention.

FIG. 18 depicts an exemplary protective pad with damping component integrated straps, in accordance with aspects of the present invention. An exterior surface 102 of the impact shell 101 is depicted with a first strap 1802 and a second strap 1804 extending from the lateral side 108. In an exemplary aspect, the first strap 1802 and the second strap 1804 may extend to the opposite side of the protective pad (e.g., medial side), as depicted by motion lines 1810 and 1820. Each of the straps may then be secured to the protective pad to maintain the protective pad in an as-worn position on a user.

The first strap includes a closure protrusion 1806. The closure protrusion 1806 is depicted as a portion of the strap 1802 extending beyond a surface, such as the inner surface. The impact shell may have a receiving cavity 1808 for receiving the closure protrusion. Similar concepts discussed with respect to FIGS. 15 and 16 for shapes, sizes, and the like of protrusions, channels, and chambers may be applicable to the receiving cavity 1808 and/or the closure protrusion 1806. It is contemplated that the closure protrusion may fit within the receiving cavity to maintain the strap 1802 in a desired coupled (e.g., decoupleable) state.

Similarly, the second strap 1804 is illustrated with an alternative arrangement having a first closure protrusion 1812 and a second closure protrusion 1814. Respective receiving cavities 1816 and 1818 are formed on the opposite side of the protective pad (e.g., formed in the impact shell, the damping component, and/or a combination) for receiving the closure protrusions. It is contemplated that any combination of closure protrusions and receiving cavities may be used in any combination. Further, it is contemplated that additional components (e.g., hook and loop material, snaps, buttons, clips, lacing, and the like) may also or alternatively be used to couple a strap to the protective pad.

Returning to the straps 1802 and 1804, it is contemplated that the straps are formed as part of the damping component. For example, in a common forming (e.g., molding) operation each of the straps are formed from the same material as is used to form the damping component. Further, it is contemplated that the straps may be considered a connecting member that extends from an edge portion of the protective pad. Further, while medial and lateral sides are called out for purposes of explaining FIG. 18, it is contemplated that a strap may originate from or terminate at any portion of the protective pad. Further, while the straps are depicted in a linear shape, it is understood that any shape, size, and orientation may be implemented.

Further, it is contemplated that rather than have the protrusions extending from the damping component they may alternatively or in addition extend from the impact shell (either the inner or outer surfaces). Further, it is contemplated that sizing of the strap may be accomplished by a series of receiving cavities or protrusions extending along a portion of the strap and/or the impact shell. For example, it is contemplated that a series of receiving cavities extends along the outer surface of the impact shell in a pattern that may be matched by two or more protrusions extending along the length of a strap.

Figure 19:
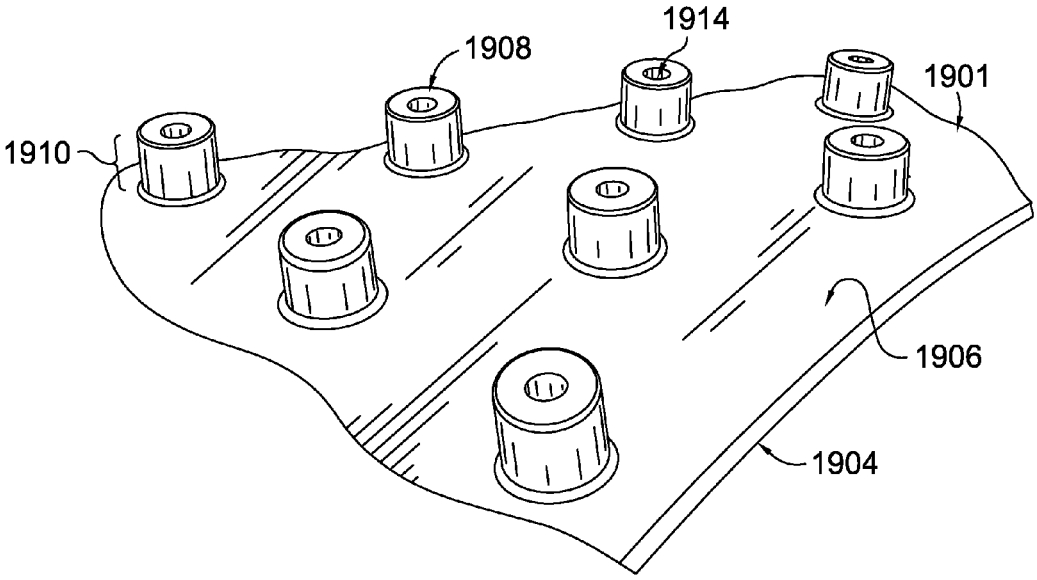
FIG. 19 depicts a perspective view of the damping component formed with a sheet-like form, in accordance with aspects of the present invention.

FIG. 19 depicts a perspective view of the damping component formed with a sheet-like form 1901, in accordance with aspects of the present invention. An inner surface 1906 of the sheet-like form 1901 is exposed along with a number of exemplary extension members 1908 and extension member voids 1914. Also illustrated is the concept of an offset 1910. The offset 1910 is the length that an extension member extends from the inner surface 1906.

In this example, an outer surface 1904 is opposite the inner surface 1906. A thickness of material extending between the inner surface 1906 and the outer surface 1904 may vary with location to achieve varied physical properties, such as elasticity, impact force attenuation, and the like. In this example, the sheet-like form 1901 may not include a void extending between the inner surface 1906 and the outer surface 1904. However, it is contemplated that one or more of the extension member voids 1914 may extend from a distal end of one or more of the extension members 1908, through the extension members, and through the sheet-like form 1901. In this example, an extension member void extending through the outer surface 1904 may form an aperture at the outer surface 1904. This aperture may be effective for facilitating the movement of air and/or moisture. Further, it is contemplated that the aperture may be effective for facilitating a better contact surface between the user and the damping component.

Figure 20:
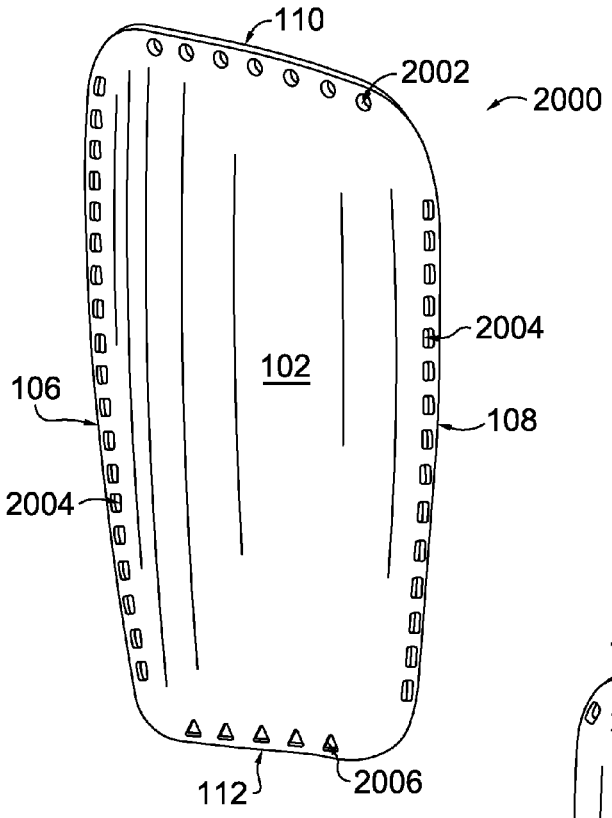
FIG. 20 depicts a front perspective view of alternative embodiments for the impact shell, in accordance with aspects of the present invention.

FIG. 20 depicts a front perspective view of an additional exemplary embodiment for the impact shell of the protective pad, in accordance with aspects of the present invention. The impact shell 2000 is depicted with the exterior surface 102 forward facing. The impact shell 2000 also has a perimeter defined, at least in part, by a top edge 110, a lateral edge 108, a bottom edge 112, and a medial edge 106. Further, the impact shell 2000 comprises a plurality of perforations or cutouts along the perimeter of the impact shell 2000. The perforations may be of uniform shape and size throughout the perimeter, or may be of different shapes and sizes (as shown). For example, the perforations may be circular perforations 2002, triangular perforations 2006, rectangular perforations 2004, or any other shape suitable or desired may be used. The perforations may be uniform in size throughout, or different sized perforations may be used for different areas around the perimeter of the impact shell 2000. Further, the perforations may be uniformly spaced apart (as shown,) or may be spaced at different length intervals around the perimeter of the impact shell 2000. As contemplated herein, a perforation extends through the impact shell from the exterior surface to the interior surface. As will be discussed hereinafter, it is contemplated that the perforations provide an area through which an overmolded material may pass during the molding process to form an affixed coupling frame.

Figure 21:
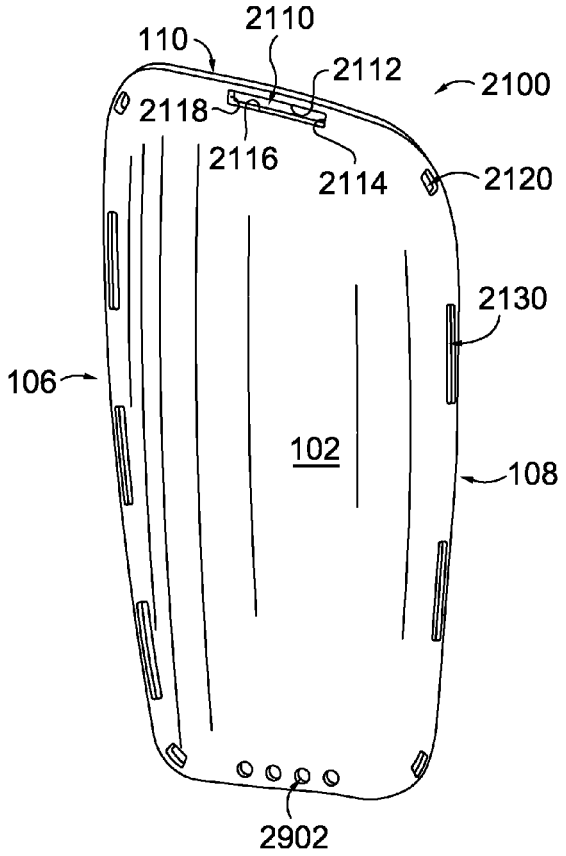
FIG. 21 depicts another front perspective view of an exemplary impact shell of the protective pad, in accordance with aspects of the present invention.

FIG. 21 depicts an exterior surface of an exemplary impact shell. For example, impact shell 2100 shown in FIG. 21 is an exemplary embodiment of the impact shell 2000. Impact shell 2100 is depicted as having a plurality of perforations 2110 along the top edge 110 and bottom edge 112, perforations 2120 along lateral edge 108 and medial edge 106, and finally perforations 2130 corresponding to the four corners of impact shell 2100. The plurality of perforations provided in impact shell 2100 are shown to have a general rectangular shape. Additionally, a plurality of circular perforations are also depicted proximate the bottom edge. An exemplary circular perforation is 2902. As previously discussed, it is contemplated that perforations may be of any size, shape, and at any location. Further, it is contemplated that any combination of size, shape, and location may be utilized in aspects of the present invention.

In this exemplary aspect, perforations 2110 are depicted as having a top edge 2112, a bottom edge 2116, a lateral edge 2114 and a medial edge 2118. The plurality of perforations 2110, 2120, and 2130 are provided along and proximate the perimeter of the impact shell 2100. The plurality of perforations may be provided closer to the top edge 110, lateral edge 108, bottom edge 112, and/or medial edge 106 than the center of the impact shell 2100, in an exemplary aspect. For example, taking the perforation 2110 near the hard shell top edge 110, the top edge 2112 of the perforation 2110 may be at least from 1 mm to 1 cm away from the corresponding hard shell top edge 110. Further, the top edge 2112 may be at least from 1 mm to 1 cm from bottom edge 2116, and lateral edge 2114 may be at least 5 mm to 5 cm from medial edge 2118, in exemplary aspects. It is contemplated that similar lengths may be applicable to other edges of alternative perforations (e.g., circumferential edge of a circular perforation).

The plurality of perforations in this exemplary embodiment of the impact shell 2100 serve as locking channels for allowing a coupling frame to be formed and locked in place around the whole perimeter (or a portion of the perimeter in an additional exemplary aspect) of the impact shell 2100. The coupling frame around the perimeter of impact shell 2100 may be formed by different suitable methods including injection molding or any other suitable technique. As such, the coupling frame may be formed on both sides of the impact shell 2100 by filling the plurality of perforations 2110, 2120, and 2130 with the coupling frame material and interconnecting the filled perforation material effectively locking the coupling frame to the impact shell by forming the coupling frame on both sides of the impact shell 2100. For example, as will be discussed hereinafter with respect to FIG. 22, the impact shell 2100 with the coupling frame 2210 formed around the perimeter of impact shell 2100 is shown in FIG. 22 as impact shell 2200.

Figure 22:
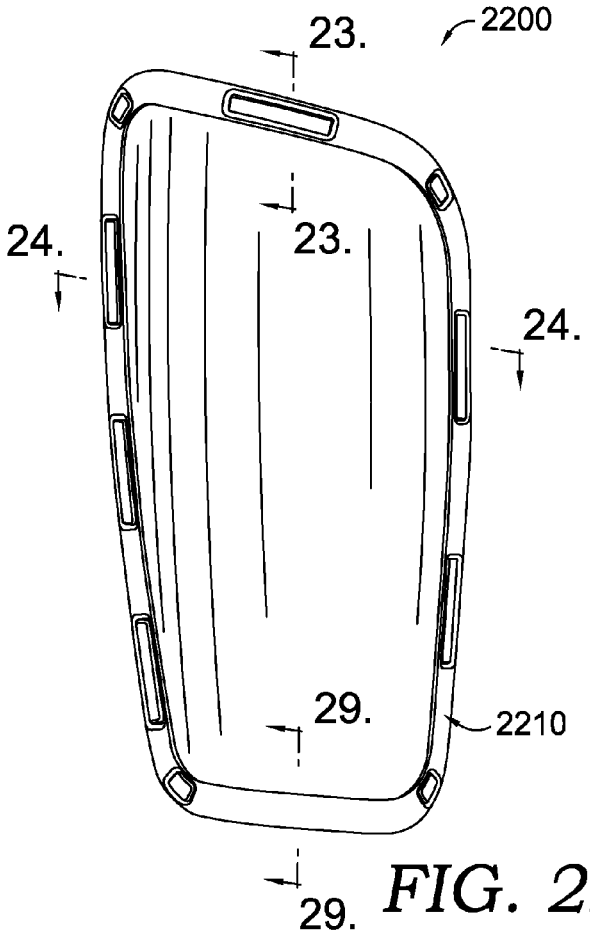
FIG. 22 depicts a front perspective view of the impact shell depicted in FIG. 21 further comprising a coupling frame around the perimeter of the impact shell, in accordance with aspects of the present invention.

FIG. 22 depicts an impact shell with an integrated coupling frame, in accordance with aspects of the present invention. The coupling frame 2210 may comprise the same elastomeric material as the damping component (not shown). In an alternative aspect, the coupling frame may be formed with a compatible material to the damping component such that the damping component and the coupling frame 2210 are able to be affixed to one another. The coupling/affixing may be accomplished with heat or ultrasonic fusion, a heat or ultrasonically activated adhesive layer, epoxies, glues, mechanical fasteners, and other coupling mechanisms may be used in order to affix the damping component and the coupling frame 2210 together, in accordance with aspects of the present invention.

The coupling frame 2210 may be formed around the perimeter of the impact shell 2100 to form impact shell 2200, for example, by placing the impact shell in a mold and filling the desired area with an elastomeric material of choice. The material is then allowed to flow through and fill each perforation in the plurality of perforations 2110, 2120, 2130, and or 2909 of FIG. 21 so that a layer is able to be formed around the perimeter on the exterior surface 102 and/or the interior surface (not shown). This filling of the perforations may form an effective locking mechanism for the coupling frame to the impact shell by incorporating the coupling frame through the impact shell perforations. Stated differently, the material forming the coupling frame extends through the perforations and around the perimeter from the top surface to the bottom surface forming an integrated coupling frame, as depicted in cross-sectional FIGS. 24, 25, and 29 hereinafter.

Further, while a plurality of dimensional features are depicted proximate some perforations (e.g., proximate cutline 23-23), it is also contemplated that the coupling frame may be substantially planar on one or more surfaces (e.g., lacking dimensional features). This planar aspect may provide a uniform coupling surface and/or a uniform appearance, in an exemplary aspect. A cutline 29-29 identifies a cross section that is depicted hereinafter in FIG. 29 having a substantially planar surface proximate circular perforation 2902 of FIG. 21.

Figure 23:
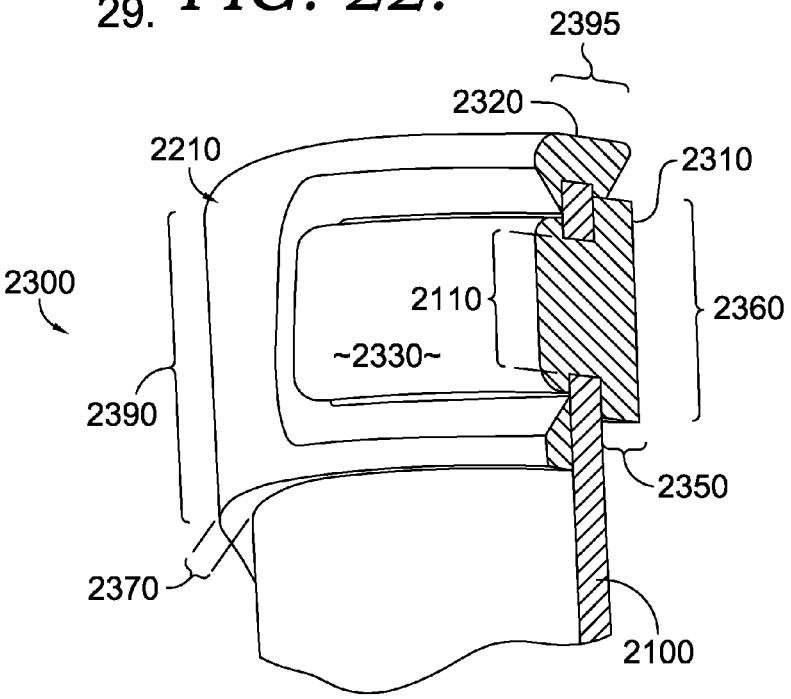
FIG. 23 depicts a cross-section along cutline 23-23 of the protective pad shown in FIG. 22, in accordance with aspects of the present invention.

FIG. 23 depicts a cross section 2300 along cutline 23-23 of FIG. 22, in accordance with aspects of the present invention. The cross section 2300 is of the top edge of the impact shell 2200 shown in FIG. 22, where the structure of coupling frame 2210 is shown in greater detail. For instance, once coupling frame 2210 is molded, or otherwise formed around a perimeter of impact shell 2100, the coupling frame 2210 has an interior face structure 2310, an exterior face structure 2330, and a top face 2320. As seen in FIG. 23, the elastomeric material comprising the coupling frame 2210 flows through perforation 2110 and according to the particular mold used when forming the depicted coupling frame in this example, coupling frame 2210 may form interior face structure 2310 having a height 2350 and a width 2360 that is wider than the width of perforation 2110. Further, coupling frame 2210 may form exterior face structure 2330 having a height 2370 and a width 2390. The total thickness 2395 of the coupling frame 2210 may be measured at any point inside the perforations 2110 or at the top face 2320. The total thickness of 2395 may include the height 2350 of interior face structure 2310, the thickness of the impact shell 2100, and the height 2370 of external face structure, in an exemplary aspect.

The coupling frame 2210 may be molded to have crests and valleys to create an aesthetically appealing effect on the exterior face structure 2330 (as shown), or may be molded to have a smooth complexion where a uniform face structure may be formed for both the exterior face structure 2330 and/or the interior face structure 2310. In an exemplary aspect, it is contemplated that an exterior face structure may not have a shape similar to that of the underlying perforations through which the material passes. For example, it is contemplated that the coupling frame may have one or more geometric features visibly formed therein on a surface (e.g., exterior face structures) that are of a different size, shape, and/or number of perforations within the impact shell proximate the feature. In an exemplary aspect, it is contemplated that multiple underlying perforations may be circular and a corresponding proximate coupling frame feature may be non-circular.

Figure 24:
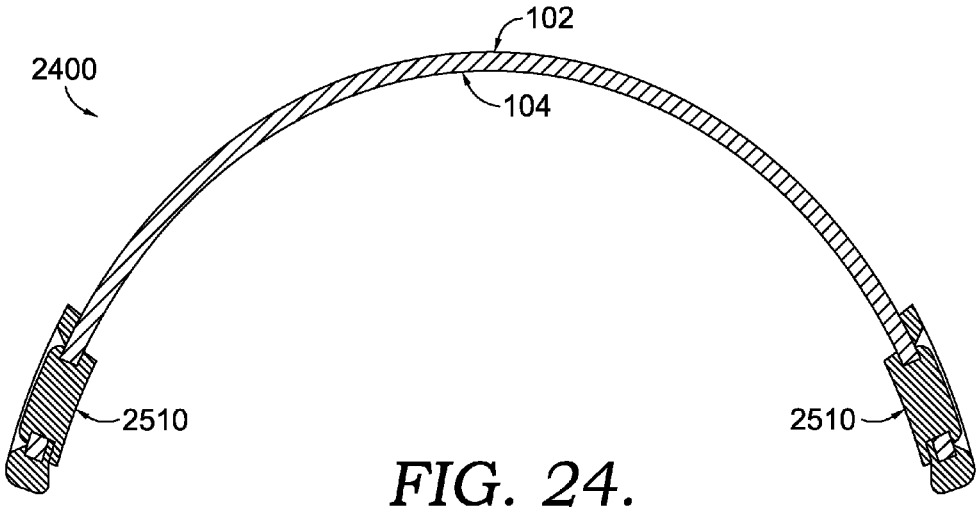
FIG. 24 depicts a horizontal cross-section along cutline 24-24 of the impact shell shown in FIG. 22, in accordance with the present invention.

FIG. 24 depicts a horizontal cross-section 2400 along cutline 24-24 of the impact shell 2200 shown in FIG. 22, in accordance with the present invention. As seen in cross-section 2400, the perimeter of the impact shell 2200 in the crossection is completely surrounded by coupling frame 2210, which is locked in place by the material overflowing from the exterior surface 102 of the impact shell 2100 through the plurality of perforations 2110, 2120, and 2130 to the inner surface 104.

Figure 25:
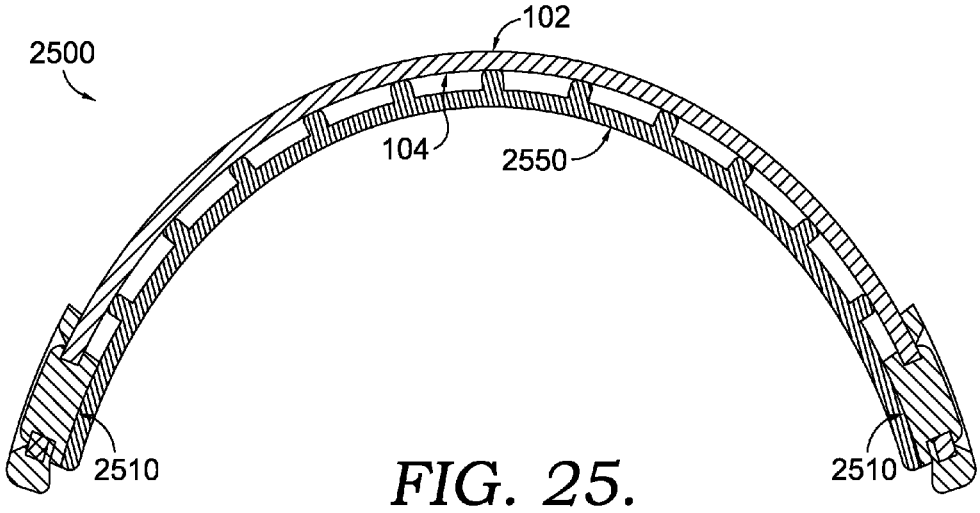
FIG. 25 depicts a horizontal cross-section along cutline 24-24 of the protective pad comprising the protective impact shell depicted in FIG. 22 in addition to an affixed protective pad, in accordance with the present invention.

FIG. 25 depicts a horizontal cross-section 2500 along cutline 24-24 of the impact shell 2200 depicted in FIG. 22 plus a damping component 2550 affixed to the impact shell 2200 by way of the coupling frame 2210 at a surface 2510, in accordance with aspects of the present invention.

Figure 26:
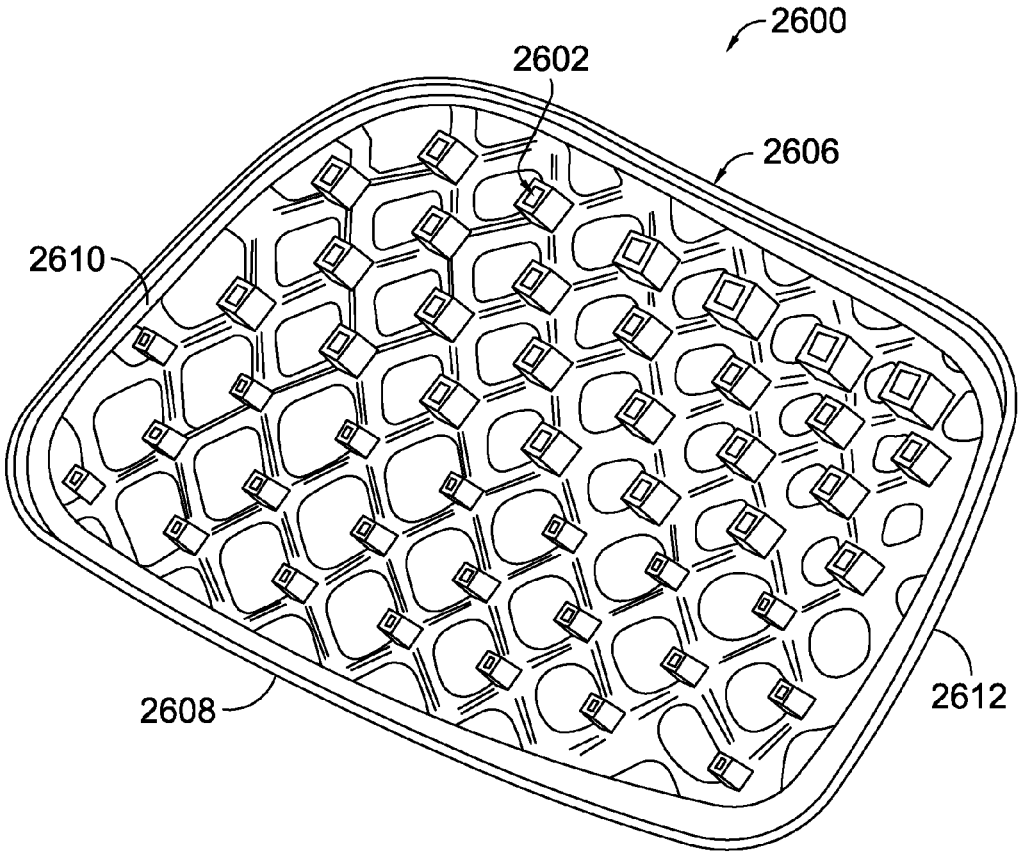
FIG. 26 depicts a damping component inner surface from which a plurality of rectangular prism extension members extend from a lattice of interconnected joining members, in accordance with aspects of the present invention.

FIG. 26 depicts a damping component 2600 inner surface from which a plurality of rectangular prism extension members 2602 extend from a lattice of interconnected joining members, in accordance with aspects of the present invention. The damping component 2600 is comprised of a top edge 2610, a bottom edge 2612, a lateral edge 2608, and a medial edge 2606. As discussed with respect to FIG. 4 previously, the joining members may be formed in a common manufacturing process, such as injection molding, such that the joining members as-a-whole form a lattice network of the damping component 2600. The joining members define a plurality of voids. The voids extend through the outer surface and an inner surface of the joining members.

At an intersection of two or more joining members an extension member, such as the extension member 2602, may be located. Further, associated with one or more extension members, an extension member void may extend through at least a portion of the extension member. However, as depicted, it is contemplated that the extension member void may not extend through the inner surface of the damping component in an exemplary aspect.

The extension member 2602 may extend from the inner surface of the damping component outwardly toward the inner surface of an impact shell, in an exemplary aspect. The extension member 2602 is depicted in a rectangular prism form extending outwardly from the lattice structure. As previously discussed, extension members may be of any size, shape, and concentration. Further, an extension member void may also be of any size and shape. As mentioned above, the extension member void of the extension member 2602 extends from the inner surface of the extension member 2602 toward the outer surface of the damping component. However, the extension member void, in this example, does not extend through the outer surface of the damping component. The maintaining of the outer surface of the damping component may provide a suitable surface onto which a skin layer may be coupled, in an exemplary aspect.

In the depicted aspect, the extension members are rectangular prism (e.g., cuboids) in nature. The geometry of a rectangular prism provides potential benefits for impact attenuation of the damping component based on the angular intersection of the various faces of the rectangular prism extensions members. It is this angular face intersection that provides, in an exemplary aspect an intentional deformation location for attenuating an impact force.

Figure 27:
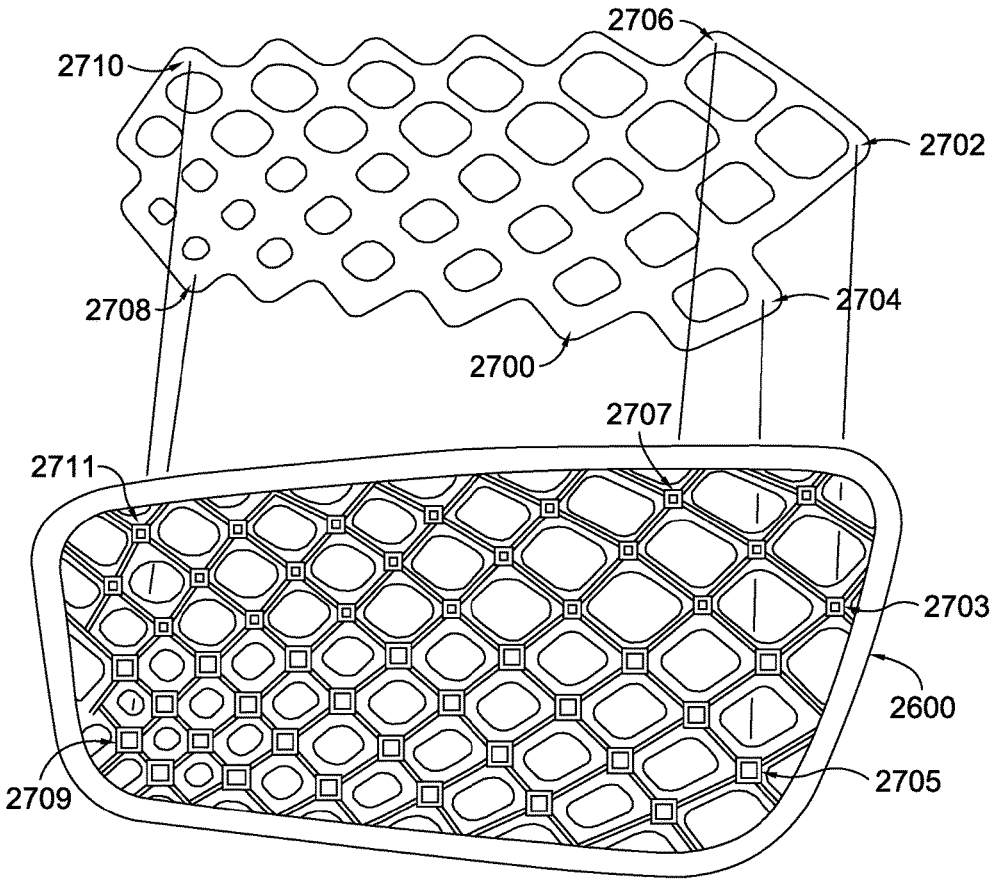
FIG. 27 depicts the inner surface of the damping component from FIG. 26 along with a skin layer to be coupled to the outer layer of the damping component, in accordance with aspects of the present invention.

FIG. 27 depicts the inner surface of the damping component 2600 from FIG. 26 along with a skin layer 2700 to be coupled to the outer surface (not depicted in FIG. 27) of the damping component 2600, in accordance with aspects of the present invention. As discussed previously with respect to FIG. 6, a skin layer may be coupled to one or more portions of an outer surface of a damping component, such as the damping component 2600.

The skin layer 2700 may be formed in any size and or shape. In an exemplary aspect, the skin layer 2700 is formed to resemble the lattice geometry to which it is coupled. Therefore, one or more voids extending through the lattice structure of the damping component 2600 may correspond to similarly sized voids extending through the skin layer 2700, as will be depicted in FIG. 28 hereinafter.

Exemplary alignment points are identified for illustrative purposes. These alignment points help facilitate an understanding of how the skin layer 2700 aligns with the non-depicted surface of the damping component 2600. For example, the skin layer 2700 illustrates alignment points 2702, 2704, 2706, 2708, and 2710. The damping component 2600 illustrates exemplary affixing points 2703, 2705, 2707, 2709, and 2711 as they relate to affixing point on the outer surface (not depicted in FIG. 27) of the damping component 2600. When the skin layer 2700 is coupled with the outer layer (not depicted in FIG. 27) of the damping component 2600, in an exemplary aspect, the affixing points 2702, 2704, 2706, 2708, and 2710 align respectively with the affixing points 2703, 2705, 2707, 2709, and 2711 as they relate to the outer surface.

Figure 28:
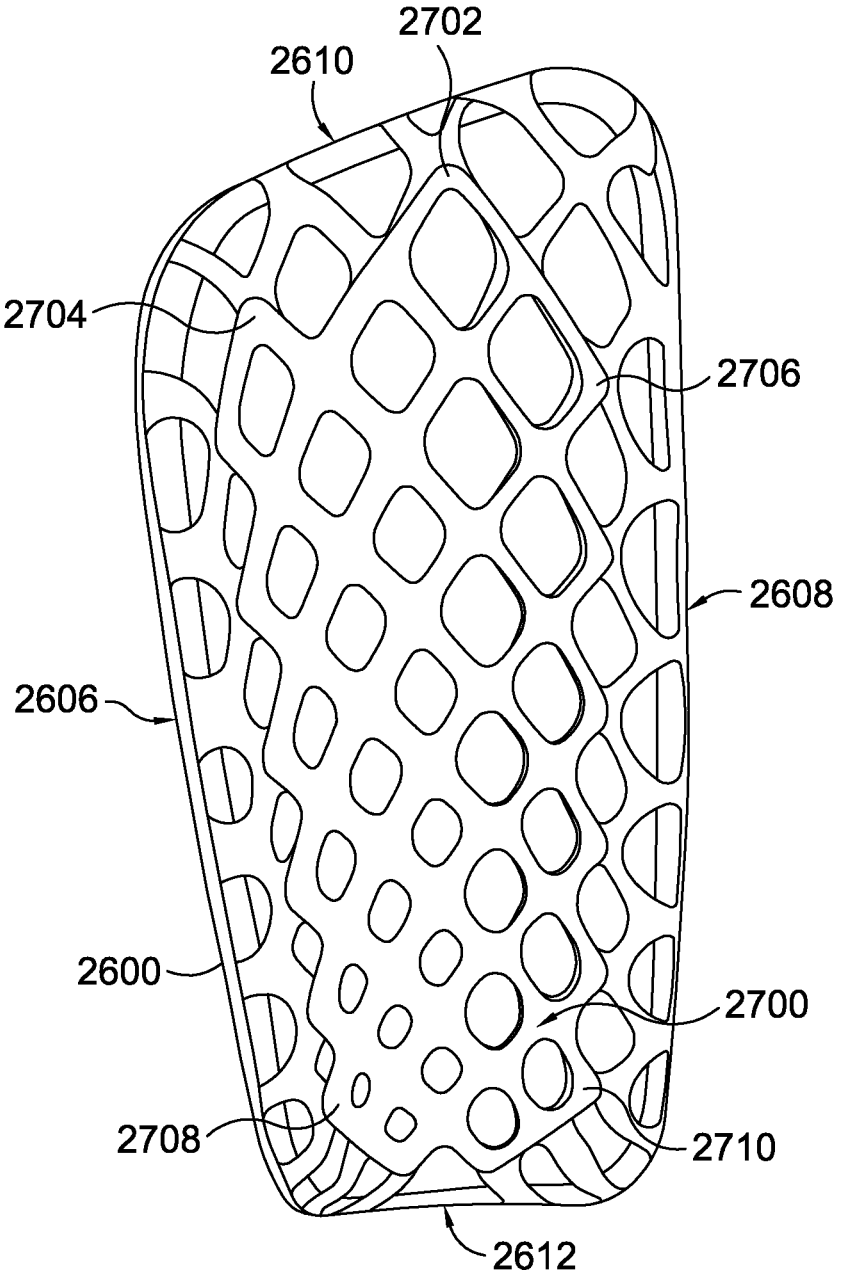
FIG. 28 depicts an outer surface perspective of the damping component from FIG. 26 and the skin layer of FIG. 27 coupled in an aligned manner, in accordance with aspects of the present invention.

FIG. 28 depicts an outer surface perspective of the damping component 2600 from FIG. 26 and the skin layer 2700 of FIG. 27 coupled in an aligned manner, in accordance with aspects of the present invention. To provide context from FIG. 27, the skin layer affixing points (i.e., 2702, 2704, 2706, 2708, and 2710) are reproduced in FIG. 28. Based on the alignment, the voids between connecting members and the voids within the skin layer 2700 are aligned, which provides, in this example, the benefits articulated herein for inclusion of the voids. Further, it is contemplated that the skin layer 2700 does not extend across the entirety of the damping component 2600 surface. The skin layer may be located in those positions of the damping component 2600 proximate a tibia region and/or a primary portion in contact with a wearer when in an as-worn position.

Figure 29:
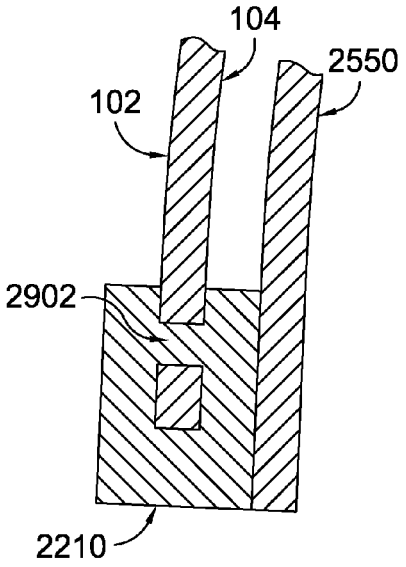
FIG. 29 depicts a cross-section along cutline 29-29 of the impact shell and coupling frame depicted in FIG. 22, in accordance with aspects of the present invention.

FIG. 29 depicts a cross-sectional view of the damping lattice 2550, the impact shell, and the coupling frame 2210 along cutline 29-29 of FIG. 22. As illustrated, the coupling frame material extends through the perforation 2902 (depicted in FIG. 21 hereinabove) to surround both the exterior surface 102 and the inner surface 104 of the impact shell. The coupling frame 2210 extends at least from the perforation 2902 past a perimeter edge of the impact shell such that the coupling frame 2210 surrounds the perimeter of the impact shell from the exterior to the interior surfaces.

As previously discussed, it is this coupling frame 2210, which may be formed from a material similar to that of the damping component 2550, that couples to the damping component 2550. Consequently, the impact shell is coupled with the damping component 2550 by way of the coupling frame 2210, in an exemplary aspect. As previously discussed, the coupling between the damping component 2550 and the coupling frame 2550 may be accomplished by way of an adhesive, a welding process, or other coupling mechanisms.

While the concepts provided herein discuss the concept of a pad and depict a shin-guard pad in particular, it is contemplated that this concept extends to all types of force attenuation applications. For example, as previously discussed, features provided herein may be utilized in connection with helmets, clothing, barriers, armor, and other applications.

The invention claimed is:

1. A protective pad comprising:

an impact shell formed from a first material, the impact shell comprised of (1) an exterior surface and an opposite interior surface, the interior surface of the impact shell having a curved profile extending outwardly in a direction of the outer surface from a medial edge to an opposite lateral edge, and (2) a perimeter defined, at least in part by the medial edge, the opposite lateral edge, a top edge, and an opposite bottom edge;

a damping lattice positioned proximate the interior surface of the impact shell, the damping lattice is formed of a second material that is different from the first material, the damping lattice is comprised of (1) a plurality of interconnected joining members having an outer surface and an opposite inner surface;

(2) a plurality of voids extending between the outer surface and the inner surface formed by the plurality of interconnected joining members; and (3) a plurality of extension members extending between the inner surface of the damping lattice and the interior surface of the impact shell the plurality of extension members including a first extension member comprising a first distal end positioned opposite the inner surface of the damping lattice and a first offset defined by a first distance that the first extension member extends from the inner surface of the damping lattice to the first distal end and a second extension member comprising a second distal end positioned opposite the inner surface of the damping lattice and a second offset defined by a second distance that the second extension member extends from the inner surface of the damping lattice to the second distal end that is different than the first distance;

a coupling frame continuously surrounding the perimeter of the impact shell; and the damping lattice affixed to the impact shell by way of the coupling frame.

2. The protective pad of claim 1, wherein the plurality of interconnected joining members form a uniform thickness from which the plurality of extension members extend.

3. The protective pad of claim 2, wherein a first void of the plurality of voids is formed by at least two interconnected joining members of the plurality of interconnected joining members.

4. The protective pad of claim 2, wherein the first extension member has a smaller cross sectional area than the second extension member.

5. The protective pad of claim 2, wherein the first extension member comprises a first extension member void extending from the first distal end of the first extension member toward the inner surface of the plurality of interconnected joining members and terminating proximate a skin layer coupled to at least a portion of the outer surface of the plurality of interconnected joining members.

6. The protective pad of claim 1, wherein the first distal end of the first extension member and the second distal end of the second extension member are directly adjacent to the interior surface of the impact shell.

* * * * *